US012697009B2

(12) United States Patent
Todd et al.

(10) Patent No.: US 12,697,009 B2
(45) Date of Patent: Aug. 4, 2026

(54) DEVICE FOR CLEANING A RECEPTACLE

(71) Applicant: Lava Wash LTD, London (GB)

(72) Inventors: Theodore James Leece Todd, London (GB); Rory Clifford Tippetts Taylor, Swindon (GB)

(73) Assignee: Lava Wash Ltd, London (GB)

( * ) Notice: Subject to any disclaimer, the term of this patent is extended or adjusted under 35 U.S.C. 154(b) by 98 days.

(21) Appl. No.: 18/835,727

(22) PCT Filed: Feb. 1, 2023

(86) PCT No.: PCT/GB2023/050220
§ 371 (c)(1),
(2) Date: Aug. 4, 2024

(87) PCT Pub. No.: WO2023/148483
PCT Pub. Date: Aug. 10, 2023

(65) Prior Publication Data

US 2025/0143533 A1 May 8, 2025

(30) Foreign Application Priority Data

Feb. 4, 2022 (GB) ..... 2201464

(51) Int. Cl.
*A47L 15/00* (2006.01)
*A47L 15/42* (2006.01)

(52) U.S. Cl.
CPC ..... *A47L 15/0065* (2013.01); *A47L 15/4278* (2013.01)

(58) Field of Classification Search
None
See application file for complete search history.

(56) References Cited

U.S. PATENT DOCUMENTS

2018/0195490 A1* 7/2018 Edenholm ..... B60S 3/048

* cited by examiner

*Primary Examiner* — Rita P Adhlakha
(74) *Attorney, Agent, or Firm* — Grimes & Yvon LLP

(57) ABSTRACT

Device (100) for cleaning a receptacle (80) comprising a receiving component for receiving and holding the receptacle, wherein the receiving component comprises a first rotating element (90) that is capable of rotating the receptacle. The device further comprises a cleaning component (110), preferably a nozzle, that is capable of cleaning at least part of the interior wall of the receptacle interior wherein the cleaning component comprises a cleaning element that is locatable within the interior space of the receptacle when the receptacle is held by the receiving component. The device (100) further comprises a rotation driving component (400) that is capable of driving rotation of the first rotating element (90), wherein the rotation driving component comprises a second rotating element (130). Further, the first rotating element (90) is magnetically coupled to the second rotating element (130) wherein the second rotating element is configured to cause rotation of the first rotating element on rotation of the second rotating element. Methods for cleaning a receptacle using the above mentioned device are also part of the present invention.

20 Claims, 15 Drawing Sheets

DEVICE FOR CLEANING A RECEPTACLE

BACKGROUND OF THE INVENTION

The present invention relates to a device, in particular a device for cleaning receptacles and a method in which the device is operated. The device can also be referred to as an appliance. Example receptacles for cleaning include drinking receptacles, such as cups, beakers, mugs, glasses, vessels and the like.

Throughout the day, people who enjoy several beverages, including but not limited to coffee, can be concerned by the residue left by the drink in the receptacle after consumption. When a new beverage is poured into the same receptacle, it is likely a person will want to wash the receptacle before use.

Current methods to remove residues in receptacles include handwashing the vessel with water, which may include the use of a utensil and/or detergent; and placing the vessel in a conventional dishwashing appliance where it will be cleaned once its cycle is initiated.

BRIEF SUMMARY OF THE INVENTION

The present invention provides a novel method to clean the dirtied beverage vessel and a device for use in said method.

In a broad aspect, the present invention provides a device for cleaning a receptacle wherein the device comprises a receiving component for receiving and holding the receptacle and a cleaning component that is extendable into at least a part of the interior of the receptacle when the receptacle is placed on the receiving component.

In another broad aspect, the present invention provides a device for cleaning a receptacle wherein the device comprises a receiving component for receiving and holding the receptacle and a cleaning component that is extendable into at least a part of the interior of the receptacle when the receptacle is placed on the receiving component; wherein the receiving component is capable of rotating the receptacle.

In another broad aspect, the present invention provides a device for cleaning a receptacle wherein the device comprises a receiving component for receiving and holding the receptacle and a cleaning component that is extendable into at least a part of the interior of the receptacle when the receptacle is placed on the receiving component; wherein the receiving component is capable of rotating the receptacle and wherein the cleaning component is in a fixed position; further wherein the receiving component and cleaning component are configured to cause at least all of the interior base of the receptacle to be engageable by the cleaning component, on rotation of the receptacle by the receiving component.

In one aspect, the present invention provides a device for cleaning a receptacle, wherein the device comprises: a receiving component for receiving and holding the receptacle, wherein the receiving component comprises a first rotating element that is capable of rotating the receptacle; a nozzle arranged to be directed at an interior of the receptacle when the receptacle is held by the receiving component; and a rotation driving component comprising a second rotating element, wherein the rotation driving component is arranged to drive rotation of the second rotating element; wherein the second rotating element is magnetically coupled to the first rotating element such that rotation of the second rotating element by the rotation driving component drives rotation of the first rotating element.

In one aspect, the present invention provides a device for cleaning a receptacle that is at least partly open-ended at one end and having an interior space defined by an interior wall; wherein the device is capable of cleaning at least a part of the interior wall of the receptacle; wherein the device comprises:

(a) a receiving component for receiving and holding the receptacle to allow for the cleaning of at least the part of the interior wall of the receptacle, wherein the receiving component comprises a first rotating element that is capable of rotating the receptacle;

(b) a cleaning component that is capable of cleaning at least part of the interior wall of the receptacle interior wherein the cleaning component comprises a cleaning element that is locatable within the interior space of the receptacle when the receptacle is held by the receiving component; and (c) a rotation driving component that is capable of driving rotation of the first rotating element, wherein the rotation driving component comprises a second rotating element;

wherein the cleaning element is capable of delivering a cleaning medium to the interior wall of the receptacle to clean at least a part of the interior wall of the receptacle;

further wherein the first rotating element is coupled to the second rotating element, wherein the second rotating element is configured to cause rotation of the first rotating element on rotation of the second rotating element.

The first rotating element is coupled to the second rotating element. Preferably, this is achieved through attractive physical forces. In a preferred aspect, the coupling is a magnetic coupling.

In one aspect, the first rotating element is coupled to the second rotating element, wherein the second rotating element is configured to cause rotation of the first rotating element on rotation of the second rotating element. In other words, the first rotating element is coupled to the second rotating element such that rotation of the second rotating element is capable of driving rotation of the first rotating element.

In one aspect, the present invention provides a device for cleaning a receptacle that is at least partly open-ended at one end and having an interior space defined by an interior wall; wherein the device is capable of cleaning at least a part of the interior wall of the receptacle; wherein the device comprises:

(a) a receiving component for receiving and holding the receptacle to allow for the cleaning of at least the part of the interior wall of the receptacle, wherein the receiving component comprises a first rotating element that is capable of rotating the receptacle;

(b) a cleaning component that is capable of cleaning at least part of the interior wall of the receptacle interior wherein the cleaning component comprises a cleaning element that is locatable within the interior space of the receptacle when the receptacle is held by the receiving component; and (c) a rotation driving component that is capable of driving rotation of the first rotating element, wherein the rotation driving component comprises a second rotating element;

wherein the cleaning element is capable of delivering a cleaning medium to the interior wall of the receptacle to clean at least a part of the interior wall of the receptacle; further wherein the first rotating element is magnetically coupled to the second rotating element, wherein the second rotating element is configured to cause rotation of the first rotating element on rotation of the second rotating element.

In another aspect, a method of cleaning a receptacle comprising use of the device according to the present invention, the method comprising: receiving the receptacle at the receiving component of the device; rotating, by the rotation driving element, the second rotating element to drive rotation of the first rotating element; and delivering, via the nozzle a cleaning medium to an interior wall of the receptacle to clean at least a part of the interior wall of the receptacle.

In another aspect, the present invention provides a method of cleaning a receptacle that is at least partly open-ended at one end and having an interior space defined by an interior wall comprising use of the device according to the present invention; wherein a receptacle is placed on the receiving component of the device and the cleaning component cleans at least part of the interior wall of the receptacle interior.

In one embodiment of the device of the present invention the receptacle is at least partly open ended at one end and having an interior space defined by an interior wall; wherein the device is capable of cleaning at least a part of the interior wall of the receptacle.

In a further embodiment, the nozzle is locatable within an interior space of the receptacle when the receptacle is held by the receiving component.

In a further embodiment, the nozzle is capable of delivering a cleaning medium to an interior wall of the receptacle to clean at least a part of the interior wall of the receptacle.

In one embodiment of the device of the present invention, the first rotating element comprises one or more magnets and/or the second rotating element comprises one or more magnets, wherein the one or more magnets are configured to cause rotation of the first rotating element on rotation of the second rotating element.

In a further embodiment, the first rotating element comprises one or more magnets, wherein the one or more magnets are configured to cause rotation of the first rotating element on rotation of the second rotating element.

In a further embodiment, the one or more magnets of the first rotating element and the one or more magnets of the second rotating element are arranged coaxially with respect to an axis of rotation of the first rotating component (90).

In a further embodiment, the one or more magnets of the first rotating element and the one or more magnets of the second rotating element are disposed apart from each other in a direction substantially perpendicular to an axis of rotation of the first rotating component (90).

In a further embodiment, the receiving component comprises a support element to support the first rotating element; wherein the support element extends into the receiving component by a distance smaller than a width of the one or more magnets of first rotating component and/or the second rotating component.

In a further embodiment, the height of a coupling region containing the one or more magnets of the first rotating component and the one or more magnets of the second rotating component in a direction parallel to the axis of rotation of the first rotating component (90) is less than the combined height of a magnet of the one or more magnets of the first rotating component and a magnet of the one or more magnets of the second rotating component.

In a further embodiment, the second rotating element comprises one or more magnets, wherein the one or more magnets are configured to cause rotation of the first rotating element on rotation of the second rotating element.

In a further embodiment, the first rotating element comprises one or more magnets and the second rotating element comprises one or more corresponding, reversed polarity magnets, wherein the corresponding, reversed polarity magnets are configured to cause rotation of the first rotating element on rotation of the second rotating element.

In a further embodiment, the first rotating element comprises a plurality of magnets and the second rotating element comprises a plurality of corresponding, reversed polarity magnets, wherein the corresponding, reversed polarity magnets are configured to cause rotation of the first rotating element on rotation of the second rotating element.

In a further embodiment, the magnets are located around the circumference of the first rotating element and/or the magnets are located around the circumference of the second rotating element.

In a further embodiment, the first rotating element and the second rotating element comprise the same number of magnets.

In a further embodiment, the first rotating element comprises two magnets and the second rotating element comprises two corresponding, reversed polarity magnets, wherein the wherein the corresponding, reversed polarity magnets are configured to cause rotation of the first rotating element on rotation of the second rotating element.

In a further embodiment, the first rotating element comprises three magnets and the second rotating element comprises three corresponding, reversed polarity magnets, wherein the corresponding, reversed polarity magnets are configured to cause rotation of the first rotating element on rotation of the second rotating element.

In a further embodiment, the first rotating element comprises four magnets and the second rotating element comprises four corresponding, reversed polarity magnets, wherein the corresponding, reversed polarity magnets are configured to cause rotation of the first rotating element on rotation of the second rotating element.

In a further embodiment, the first rotating element comprises five magnets and the second rotating element comprises five corresponding, reversed polarity magnets, wherein the corresponding, reversed polarity magnets are configured to cause rotation of the first rotating element on rotation of the second rotating element.

In a further embodiment, the first rotating element comprises six magnets and the second rotating element comprises six corresponding, reversed polarity magnets, wherein the corresponding, reversed polarity magnets are configured to cause rotation of the first rotating element on rotation of the second rotating element.

In a further embodiment, the first rotating element comprises more than six magnets and the second rotating element comprises more than six corresponding, reversed polarity magnets, wherein the corresponding, reversed polarity magnets are configured to cause rotation of the first rotating element on rotation of the second rotating element.

In one embodiment of the present invention, obstruction or prevention of the rotation of the first rotating element does not obstruct or prevent rotation of the second rotating element.

In a further embodiment, the first rotating element is capable of disengaging and/or slipping from the second rotating element.

In a further embodiment, the first rotating element disengages and/or slips from the second rotating element when there is a force opposing the rotation of the first rotating element.

In a further embodiment, the first rotating element disengages and/or slips from the second rotating element when there is a force opposing the rotation of the first rotating element that exceeds the force of the coupling between the first rotating element and the second rotating element.

In a further embodiment, the first rotating element disengages and/or slips from the second rotating element when there is a force opposing the rotation of the first rotating element that exceeds the attractive physical force between the first rotating element and the second rotating element.

In a further embodiment, the first rotating element disengages and/or slips from the second rotating element when there is a force opposing the rotation of the first rotating element that exceeds the force of the magnetic coupling between the first rotating element and the second rotating element.

In one embodiment of the device of the present invention, the first rotating element disengages and/or slips from the second rotating element when a force of more than about 5 Newton-centimetres is applied at the pivot point of the first rotating element.

In one embodiment of the device of the present invention, the first rotating element disengages and/or slips from the second rotating element when a force of more than about 10 Newton-centimetres is applied at the pivot point of the first rotating element.

In one embodiment of the device of the present invention, the first rotating element disengages and/or slips from the second rotating element when a force of more than about 30 Newton-centimetres is applied at the pivot point of the first rotating element.

In a preferred embodiment of the device of the present invention, the first rotating element disengages and/or slips from the second rotating element when a force of more than about 50 Newton-centimetres is applied at the pivot point of the first rotating element.

In one embodiment of the device of the present invention, the first rotating element disengages and/or slips from the second rotating element when a force of more than about 100 Newton-centimetres is applied at the pivot point of the first rotating element.

In one embodiment of the device of the present invention, the first rotating element disengages and/or slips from the second rotating element when a force of more than about 200 Newton-centimetres is applied at the pivot point of the first rotating element.

In one embodiment of the device of the present invention, the first rotating element disengages and/or slips from the second rotating element when a force of less than about 3000 Newton-centimetres or more is applied at the pivot point of the first rotating element.

In one embodiment of the device of the present invention, the first rotating element disengages and/or slips from the second rotating element when a force of less than about 1000 Newton-centimetres or more is applied at the pivot point of the first rotating element.

In one embodiment of the device of the present invention, the first rotating element disengages and/or slips from the second rotating element when a force of less than about 500 Newton-centimetres or more is applied at the pivot point of the first rotating element.

In one embodiment of the device of the present invention, the first rotating element disengages and/or slips from the second rotating element when a force of less than about 400 Newton-centimetres or more is applied at the pivot point of the first rotating element.

In a preferred embodiment of the device of the present invention, the first rotating element disengages and/or slips from the second rotating element when a force of less than about 300 Newton-centimetres or more is applied at the pivot point of the first rotating element.

In one embodiment of the device of the present invention, the first rotating element disengages and/or slips from the second rotating element when a force of less than about 200 Newton-centimetres or more is applied at the pivot point of the first rotating element.

In one embodiment of the device of the present invention, the first rotating element disengages and/or slips from the second rotating element when a force of less than about 100 Newton-centimetres or more is applied at the pivot point of the first rotating element.

In one embodiment of the device of the present invention, the first rotating element disengages and/or slips from the second rotating element when a force of about 5 Newton-centimetres to about 3000 Newton-centimetres is applied at the pivot point of the first rotating element.

In one embodiment of the device of the present invention, the first rotating element disengages and/or slips from the second rotating element when a force of about 10 Newton-centimetres to about 1000 Newton-centimetres is applied at the pivot point of the first rotating element.

In one embodiment, the first rotating element disengages and/or slips from the second rotating element when a force of about 30 Newton-centimetres to about 500 Newton-centimetres is applied at the pivot point of the first rotating element.

In a preferred embodiment of the device of the present invention, the first rotating element disengages and/or slips from the second rotating element when a force of about 50 Newton-centimetres to about 300 Newton-centimetres is applied at the pivot point of the first rotating element.

In one embodiment of the device of the present invention, the first rotating element disengages and/or slips from the second rotating element when a force of about 50 Newton-centimetres to about 200 Newton-centimetres is applied at the pivot point of the first rotating element.

In one embodiment of the device of the present invention, the first rotating element disengages and/or slips from the second rotating element when a force of about 50 Newton-centimetres to about 100 Newton-centimetres is applied at the pivot point of the first rotating element.

In one embodiment, the first rotating element disengages and/or slips from the second rotating element when a force of about 100 Newton-centimetres to about 300 Newton-centimetres is applied at the pivot point of the first rotating element.

In one embodiment of the device of the present invention, the first rotating element disengages and/or slips from the second rotating element when a force of about 200 Newton-centimetres to about 300 Newton-centimetres is applied at the pivot point of the first rotating element.

In one embodiment of the device of the present invention, the first rotating element disengages and/or slips from the second rotating element when a force of about 50 Newton-centimetres is applied at the pivot point of the first rotating element.

In one embodiment of the device of the present invention, the first rotating element disengages and/or slips from the second rotating element when a force of about 100 Newton-centimetres is applied at the pivot point of the first rotating element.

In one embodiment of the device of the present invention, the first rotating element disengages and/or slips from the second rotating element when a force of about 200 Newton-centimetres is applied at the pivot point of the first rotating element.

In one embodiment of the device of the present invention, the first rotating element disengages and/or slips from the second rotating element when a force of about 300 Newton-centimetres is applied at the pivot point of the first rotating element.

In a further embodiment the disengaging and/or slipping of the first rotating element from the second rotating element results in the speed of rotation of the first rotating element (measured in revolutions per minute or RPM) falling below the speed of rotation of the second rotating element.

In a further embodiment the disengaging and/or slipping of the first rotating element from the second rotating element results in the first rotating element ceasing to rotate.

In a further embodiment, the first rotating element will re-engage with the second rotating element when the force opposing the rotation of the first rotating element falls below the force of the coupling between the first rotating element and the second rotating element.

In a further embodiment, the first rotating element will re-engage with the second rotating element when the force opposing the rotation of the first rotating element falls below the attractive physical force between the first rotating element and the second rotating element.

In a further embodiment, the first rotating element will re-engage with the second rotating element when the force opposing the rotation of the first rotating element falls below the force of the magnetic coupling between the first rotating element and the second rotating element.

In one embodiment, the device of the present invention does not comprise a mechanical connection between the first rotating element and the second rotating element.

In one embodiment, the device of the present invention does not comprise a mechanical connection between the first rotating element and any other component of the device.

In one embodiment of the device of the present invention, the first rotating element can be removed from the device by overcoming the coupling between the first rotating element and the second rotating element.

In one embodiment of the device of the present invention, the first rotating element can be removed from the device by overcoming the attractive physical force between the first rotating element and the second rotating element.

In one embodiment of the device of the present invention, the first rotating element can be removed from the device by overcoming the magnetic coupling between the first rotating element and the second rotating element.

In one embodiment, the device of the present invention comprises a watertight barrier between the first rotating element and the second rotating element.

In one embodiment of the device of the present invention, the receiving component comprises a basin element that is capable of capturing spent cleaning medium.

In one embodiment of the device of the present invention, the second rotating element is locatable outside of the basin element.

In a further embodiment, at least part of the basin element is locatable between the first rotating element and the second rotating element.

In a further embodiment, the first rotating element is locatable within the basin element.

In a further embodiment of the device of the present invention, the second rotating element is locatable outside of the basin element and the first rotating element is locatable within the basin element.

In one embodiment of the device of the present invention, the cleaning element faces a part of the interior wall of the receptacle.

In a further embodiment, the first rotating element is capable of allowing rotation of the interior wall of the receptacle relative to the cleaning element.

In a further embodiment, the cleaning element is in a fixed position.

In a further embodiment, at least a part of the cleaning component is located within the receiving component.

In a further embodiment, the cleaning element extends beyond the receiving component.

In one embodiment of the device of the present invention, the first rotating element comprises a turntable element that is capable of rotating the receptacle.

In a further embodiment, the cleaning element extends beyond the turntable element.

In one embodiment of the device of the present invention, the rotation driving component comprises a means for driving the rotation of the second rotation element.

In one embodiment of the device of the present invention, the means for driving the rotation of the second rotation element comprises a motor.

In one embodiment, the means for driving the rotation of the second rotation element comprises a motor fitted with a drive gear.

In one embodiment of the device of the present invention, the second rotating element comprises a driven gear.

In a further embodiment, the drive gear is operably connected to the driven gear, wherein the drive gear is configured to cause rotation of the driven gear on rotation of the drive gear.

In a further embodiment, the motor is an electric motor.

In one embodiment, the drive gear has a diameter that is less than the diameter of the second rotating element gear.

In one embodiment of the device of the present invention, the rotation driving component comprises a controller for the motor, wherein the controller allows for the rotational speed of the first rotating element to be altered.

In one embodiment, the receiving component and/or the cleaning component comprises a drain outlet for removal of spent cleaning medium.

In a further embodiment, the receiving component comprises a drain outlet for removal of spent cleaning medium.

In a further embodiment, the drain component comprises a drain outlet for removal of spent cleaning medium.

In a further embodiment, the basin element comprises a drain outlet for removal of spent cleaning medium and the cleaning component comprises a drain closure element.

In one embodiment, the cleaning component of the device of the present invention comprises a cleaning medium preparation element that is operably connected to the cleaning element.

In a further embodiment, the device is capable of cleaning at least all of the interior base of the receptacle.

In a further embodiment, the device is capable of cleaning all of the interior wall of the receptacle.

In a further embodiment, the cleaning element comprises a nozzle through which the cleaning medium passes onto the interior wall of the receptacle.

In a further embodiment, the cleaning medium comprises heated water.

In one embodiment, the cleaning medium comprises steam.

In one embodiment, the device of the present invention further comprises a user interface module to allow a user to use the device.

In a further embodiment, the cleaning component and the receiving component are housed in an integral unit.

In a further embodiment, the cleaning component and the receiving component are housed in an integral unit; and wherein the device further comprises a user interface module to allow a user to use the device; wherein the user interface module is located on one wall of the user interface module.

In one embodiment of the present invention, the user interface module allows for the rotational speed of the first rotating device to be altered.

In a further embodiment, the user interface module allows for different rotational speeds according to a pre-programmed cycle that the user selects.

In one embodiment, the device is capable of cleaning one or more receptacles.

In one embodiment, the device is configured to clean one receptacle at a time.

In one embodiment, the receptacle is open-ended at one end.

In one embodiment, the receptacle is a receptacle for a beverage.

In one embodiment, the receptacle is a receptacle for a coffee beverage.

In one embodiment, the receptacle is cleaned by the device in a period of less than about 30 seconds.

In one embodiment, the receptacle is cleaned by the device in a period of less than about 25 seconds.

In one embodiment, the receptacle is cleaned by the device in a period of less than about 20 seconds.

In one embodiment, the receptacle is cleaned by the device in a period of less than about 15 seconds.

In one embodiment, the receptacle is cleaned by the device in a period of about 10 seconds or less than about 10 seconds.

Depending on the configuration of the receiving component, in use the receptacle is placed over the receiving component or the receiving component enters into the receptacle.

Preferably, the device is configured such that in use the receptacle is placed over the receiving component. This allows for ease of use and allows for easy cleaning of the receptacle and also for easy removal of the spent cleaning medium.

In one embodiment, the device is configured such that in use the receptacle is placed over the first rotating element.

The present invention has a number of advantages. For example, the present invention provides and allows a person to place the dirtied receptacle into the appliance wherein the receptacle is washed in a very short period of time and wherein any residues are removed from the interior of the receptacle. The receptacle can be washed in a period of time less than about 30 seconds, preferably less than about 25 seconds, preferably less than about 20 seconds, preferably less than about 15 seconds, preferably less than about 10 seconds.

The device of the present invention can wash the interior of the receptacle more effectively than an equivalent hand-washing process.

In a preferred embodiment, the cleaning component provides or delivers steam as the cleaning medium, such as pressurised steam, into the interior of the receptacle. The use of steam is effective in removing residues in the interior of the receptacle and reduces the prevalence of bacterial growth should the receptacle be the left for an extended period of time following the consumption of a previous beverage.

The device of the present invention can reduce the water consumption of the process when compared to an equivalent wash by hand or even through the use of a dishwasher.

The present invention is particularly useful in an office environment or in a coffee shop environment or in a tea shop environment. More particularly, the present invention is particularly useful in a coffee shop environment or in a tea shop environment whereby store customers may hand over a dirtied receptacle to the store staff. A staff member can make use of the device of the current invention to remove easily and quickly any residues in the interior of the receptacle while they begin to prepare the beverage. This saves time as the staff member is no longer required to hand wash the receptacle in order to make it clean for serving the fresh beverage.

According to the present invention, the receiving component comprises a first rotating element that is capable of rotating the receptacle. The first rotating element is coupled to the second rotating element. Preferably, this is achieved through attractive physical forces. In a preferred aspect, the coupling is a magnetic coupling. The second rotating element is configured to cause rotation of the first rotating element on rotation of the second rotating element.

Rotation of the first rotating element being driven by coupling, preferably through attractive physical forces and more preferably through a magnetic coupling, to a second rotating element has a number of advantages over use of a traditional mechanical connection, such as a shaft, to drive rotation of the first rotating element. One such advantage is that the present invention has a simplified design and overcomes issues arising from cavities that are associated with such mechanical connections. One such problem is the build-up of washing residue, for example coffee grounds, in the cavities, which can lead to the rotational action mechanical connector becoming obstructed resulting in reliability problems with the device. A further problem associated with cavities is the build-up of organic matter, such as milk residue, that may allow for potentially harmful micro-organisms to populate in the receiving component. Hence the first rotating element being driven by coupling, preferably through attractive physical forces and more preferably through a magnetic coupling, to a second rotating element results in the device having increased reliability and safety in use.

Further, removing the need for a mechanical connection between the first rotating element and the rotation driving component allows for increased ease in manufacture and maintenance of the device. A watertight separation between the rotation driving component and spent cleaning medium is easier to achieve, since there are fewer mechanical connectors required. For the same reason, the watertight seal between the rotation driving component and spent cleaning medium is more reliable.

Rotation of the first rotating element being driven by coupling, preferably through attractive physical forces and more preferably through a magnetic coupling, to a second rotating element, rather than a mechanical connection, also overcomes issues that arise when users drop objects into or onto the receiving component that obstruct the rotation of the first rotating element. In designs wherein the rotation of the first rotating element is driven by mechanical connection, such as a shaft, such obstructions result in damage to the device, in particular to the mechanically coupled component that drives rotation of the first rotating element. This problem is overcome wherein rotation of the first rotating element is driven by coupling, preferably through attractive physical forces and more preferably through a magnetic coupling, since the first rotating element is able to disengage and/or slip, whilst allowing the coupled second rotating element to continue rotating as normal. Therefore, any obstruction to the first rotating element will not result in sudden strain or damage to the component that drives the rotation of the first rotating element.

A further advantage of the present invention and the potential for the first rotating element to disengage and/or slip from the second rotating element when there is a force opposing the rotation of the first rotating element is that it makes the device safer to use. For instance, if a user were to insert their hand into the device and contact the first rotating element, the rotation of the first rotating element would slow or cease. Thus, the present invention is less likely to cause injury to users and has improved safety.

Further advantages of rotation of the first rotating element being driven by coupling, preferably through attractive physical forces and more preferably through a magnetic coupling, to a second rotating element, rather than a mechanical connection, include increased ease in maintenance of the device. For instance, the connection between the first rotating element and the second rotating element being a magnetic, rather than a mechanical connection, means that the first rotating element can be removed with increased ease, for instance during cleaning or routine maintenance.

To implement the magnetic coupling, both the first rotating element and the second rotating element may be provided with a respective set of one or more magnets. In some examples, the two sets of magnets are arranged in a 'face-to-face' arrangement, where the sets of magnets are offset in a vertical direction (i.e., a direction parallel to the axis of rotation of the first rotating element).

In some examples however, a coaxial arrangement of the one or more magnets in the first rotating element and the one or more magnets in the second rotating element is used. According to such an arrangement, the magnets of the first rotating element and the magnets of the second rotating element are arranged coaxially with respect to the axis of rotation of the first rotating component. For example, magnets may be arranged around (or in the vicinity of) the edge (e.g., circumference) of the first rotating element. The corresponding set of reversed polarity magnets may be positioned in the second rotating element at a slightly larger radial displacement from the axis of rotation.

By employing this coaxial arrangement, it may be possible to make the device more compact. Specifically, a vertical height (in the direction of the axis of rotation) of the wash chamber can be reduced since the two sets of magnets are arranged in substantially the same horizontal plane. Accordingly, a height of the coupling region in which the set of magnets forming the magnetic coupling are placed can be reduced as compared with, for example, the face-to-face arrangement mentioned above whereby one set of magnets is positioned below the other.

Additionally, or alternatively, the coaxial arrangement for the magnetic coupling can lead to improved efficiency of the rotation mechanism. With the face-to-face arrangement for example, the magnetic force between the two sets of magnets acts in a vertical direction, thereby increasing a vertical component of the force exerted by the first rotating component on other components of the device (and correspondingly by those other components on the first rotating component). This consequently increases the friction experienced by the first rotating element that acts to restrict its rotation. By adopting the coaxial arrangement, the vertical component of the force between the first rotating component and surrounding components in the device can be reduced leading to reduced friction restraining the motion of the first rotating device. Thus the mechanism can be made more efficient, allowing less motor power to be used to drive rotation of the first rotating element for a given amount of torque.

Even further, the coaxial arrangement described herein allows the first rotating element to have a smaller contact area with a support element (e.g., the floor/shelf of the wash basin).

With the magnets arranged coaxially, the support element provided to support the first rotating element within the receiving component does not need to support magnets arranged above and below the support element and so does not need to extend so far in the wash basin. For example the support element may extend into the receiving component in which the receptacle is placed by a distance smaller than a width of the magnets used in the first rotating element and/or the second rotation element. This arrangement can therefore provide improved drainage from the wash basin and reduce the risk of blockages.

The device can receive one or a plurality of receptacles. If the device is capable of receiving a plurality of receptacles then the device may comprise a further rotating platform wherein the platform comprises discrete receiving components for the receptacles. In one preferred aspect, the device is to receive one receptacle at a time.

Examples of receptacles include drinking receptacles, such as cups, beakers, mugs and the like. The receptacle may be of any suitable material, such as china, porcelain, ceramics, plastics etc. Preferably, the receptacle is made from a plastics material. In one aspect, the receptacle is a re-usable coffee cup, in particular a re-usable coffee cup made from a plastic material or glass.

As mentioned above, the device of the present invention enables a user to remove effectively residue from said receptacle and to clean the interior of the receptacle in a short period of time and preferably in a shorter period of time such as with hand washing.

BRIEF DESCRIPTION OF THE DRAWINGS

The present invention will now be described by way of example only and with reference to the following Figures.

Figure 1:
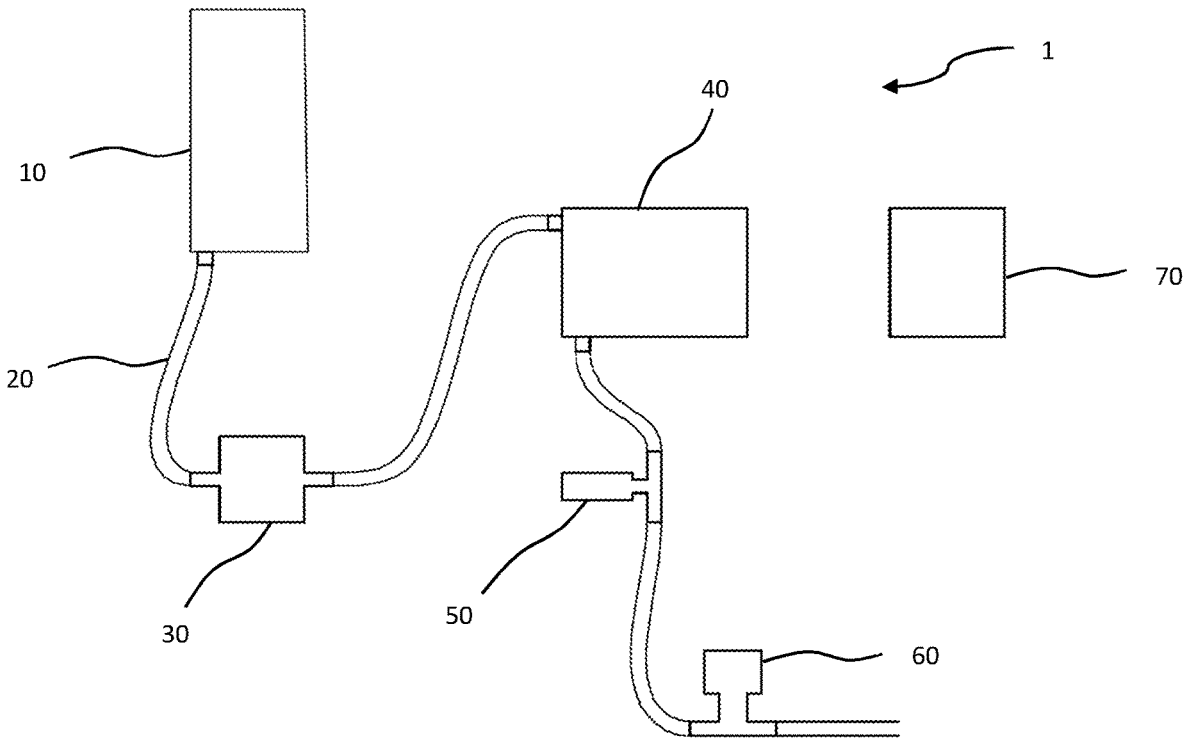
FIG. 1—which presents a schematic diagram of the cleaning component of the device of the present invention.

In the Examples, reference will be made to the following elements shown in the Figures:

1—Cleaning medium (for example steam) generating system of the cleaning component of the device.
10—Liquid source, such as a fresh water source, such as a water reservoir or a mains water inlet.
20—Hose.
30—Electric water pump.
40—Electric water heating block having an inlet and an outlet.
50—Electronic pressure transducer.
60—Valve—such as a solenoid valve.
70—Electronic control box with microprocessor.
80—Receptacle—such as a beverage vessel.
81—Open—end of receptacle
82—Interior space of receptacle
83—Interior wall of receptacle
90—First rotating element—such as an upper turntable.
95—Drain outlet to waste.
97—Drain.
100—Rotary washing bay of the receiving component of the device.
110—Cleaning element—such as a nozzle.
120—Shaft.
130—Second rotating element—such as a lower turntable.
140—Drain enclosure.
150—Electric Motor.
160—Gear attached to second rotating element.
170—A worm drive attached to motor.
180—Hose.
195—Bearing.
200—Device.
210—Rotating lid.
220—Human User Interface Module—can comprise a display and/or buttons, such as an LCD display.
230—Casing.
315—Array of magnets
320—Basin element
322—Basin shelf
400—Rotation driving component
410—Gear attached to motor
460—Array of magnets corresponding, reversed polarity to 315
470—Gearbox housing

DETAILED DESCRIPTION OF THE INVENTION

Reference will now be made in detail to embodiments of the invention examples of which are illustrated in the accompanying drawings. Since the invention may be modified in various ways and may have various forms, specific embodiments are illustrated in the drawings and are described in detail in the specification. However, it should be understood that the invention is not limited to specific disclosed embodiments, but includes all modifications, equivalents and substitutes included within the technical scope of the invention.

The terms 'first', 'second', etc., may be used to describe various components, but the components are not limited by such terms. The terms are used only for the purpose of distinguishing one component from other components.

For example, a first component may be designated as a second component without departing from the scope of the embodiments of the invention. In the same manner, the second component may be designated as the first component.

The term "and/or" encompasses both combinations of the plurality of related items disclosed and any item from among the plurality of related items disclosed.

When an arbitrary component is described as "being connected to" or "being linked to" another component, this should be understood to mean that still another component (s) may exist between them, although the arbitrary component may be directly connected to, or linked to, the second component.

On the other hand, when an arbitrary component is described as "being directly connected to" or "being directly linked to" another component, this should be understood to mean that no other component exists between them.

The terms used in this application are used to describe only specific embodiments or examples, and are not intended to limit the invention. A singular expression can include a plural expression as long as it does not have an apparently different meaning in context.

In this application, the terms "include" and "have" should be understood to be intended to designate that illustrated features, numbers, steps, operations, components, parts or combinations thereof exist and not to preclude the existence of one or more different features, numbers, steps, operations, components, parts or combinations thereof, or the possibility of the addition thereof.

In the drawings, the thickness of layers, films, panels, regions, etc., are exaggerated for clarity. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Unless otherwise specified, all of the terms which are used herein, including the technical or scientific terms, have the same meanings as those that are generally understood by a person having ordinary knowledge in the art to which the invention pertains.

The terms defined in a generally used dictionary must be understood to have meanings identical to those used in the context of a related art, and are not to be construed to have ideal or excessively formal meanings unless they are obviously specified in this application.

The following example embodiments of the invention are provided to those skilled in the art in order to describe the invention more completely. Accordingly, shapes and sizes of elements shown in the drawings may be exaggerated for clarity.

Example embodiments of the invention will be described with reference to the accompanying drawings.

Figure 6:
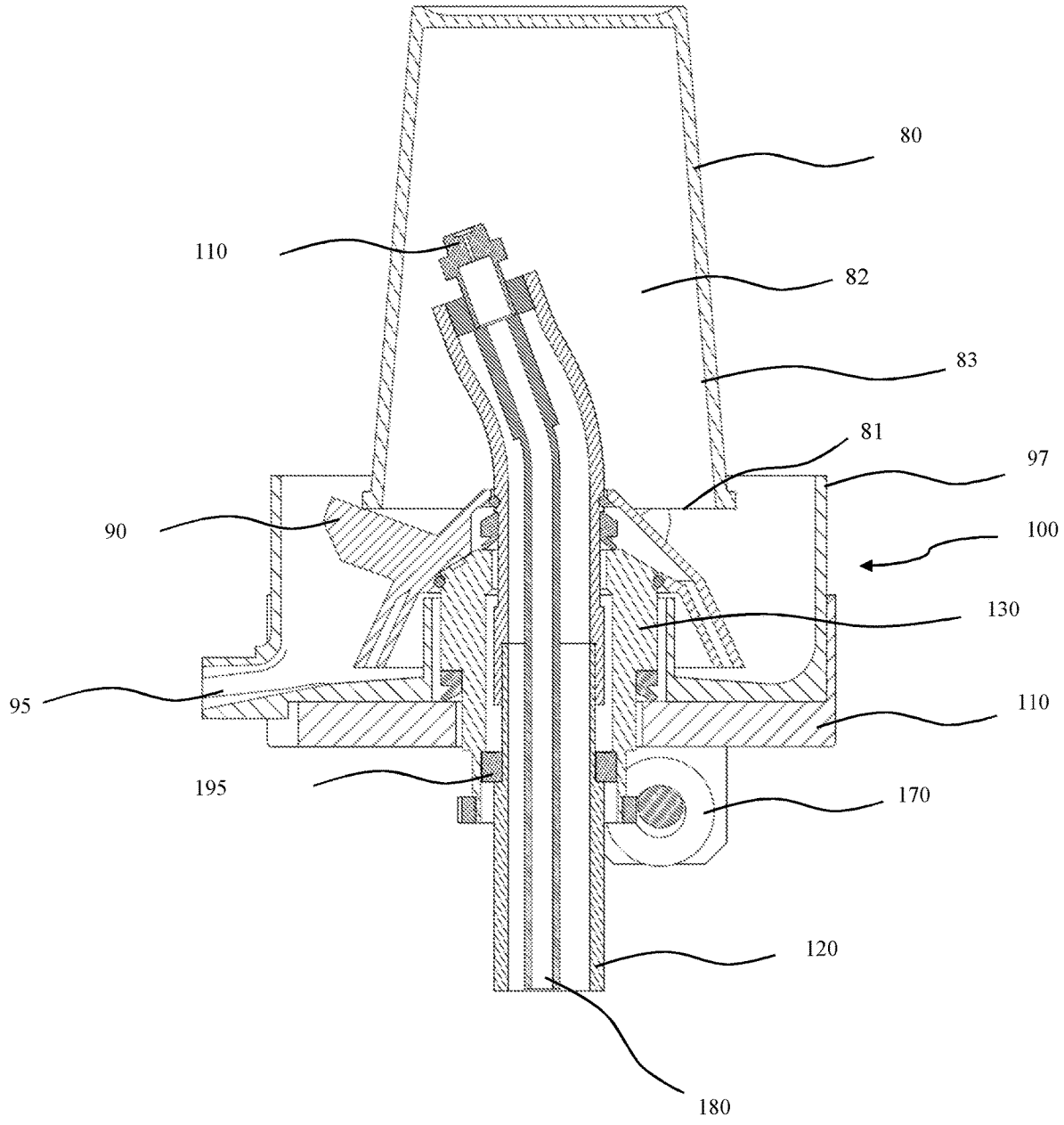
FIG. 6—which presents a cross-sectional view of the receiving component of the device of the present invention and the Receptacle.
Figure 7:
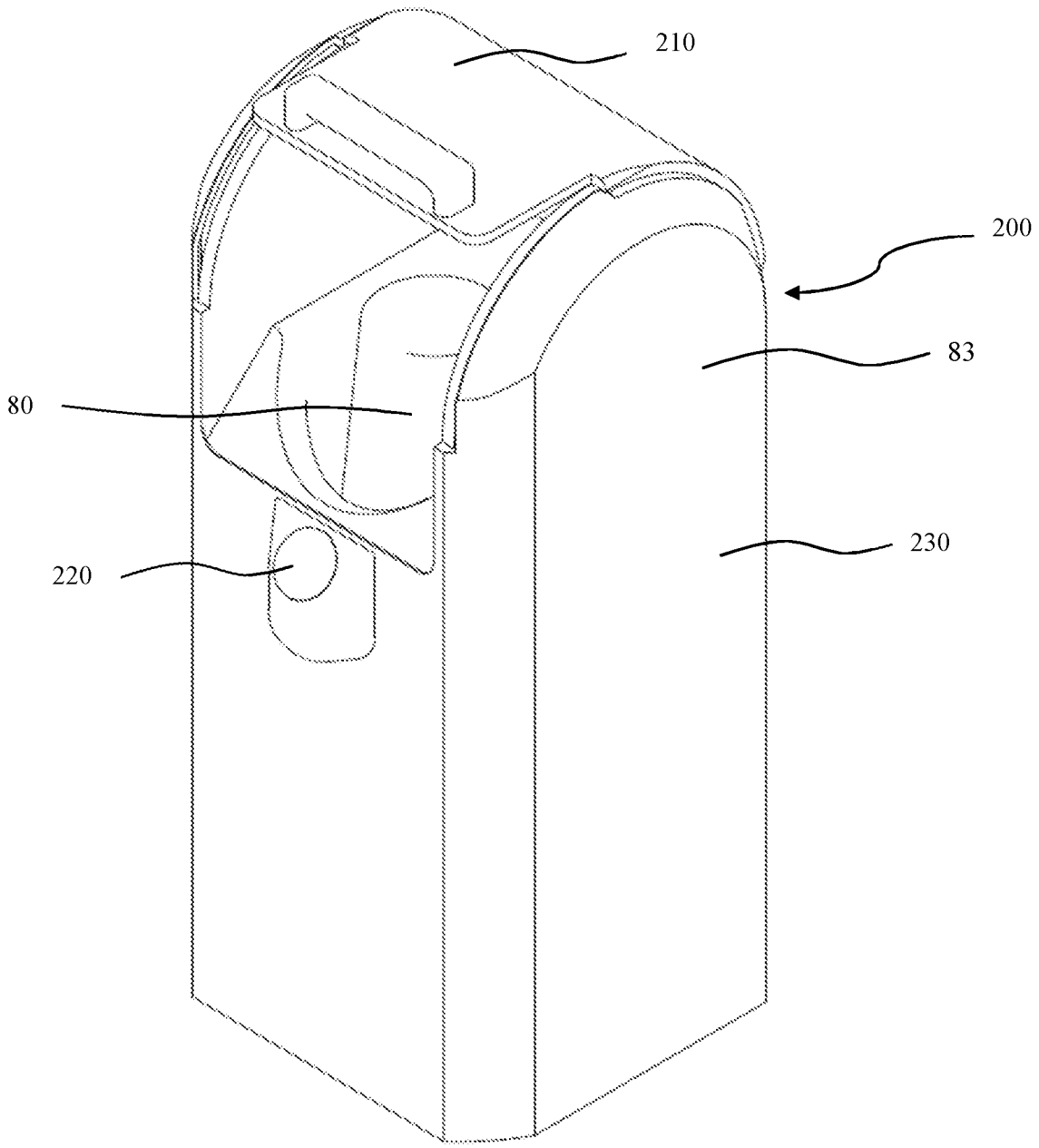
FIG. 7—which presents a view of the device of the present invention.

The device of the present invention-generally shown as 200 in FIG. 7—comprises a receiving component for receiving and holding a receptacle and a cleaning component that is extendable into at least a part of the interior of the receptacle when the receptacle is placed on the receiving component. The receiving component of the device is illustrated in FIGS. 2-6 and 8-11. Further elements thereof may be seen in FIG. 7. The cleaning component of the device is illustrated in FIG. 1. A preferred embodiment of the rotation driving component is illustrated in FIG. 9. In the Figures the receptacle is presented as receptacle 80, which is not part of the device as such but is shown for ease of understanding of the present invention. The receptacle 80 is open-ended at one end 81 and has an inner wall 83 and an inner base that defines an inner space 82.

Referring to FIG. 1 the cleaning medium generating system 1 of the cleaning component of the device comprises a system that generates steam that is used to clean the interior of a receptacle (not shown in FIG. 1). The cleaning medium generating system 1 comprises a water source 10 operably connected to a hose 20 that is operably connected to a water pump 30. Water pump 30 is operably connected to a water heater 40 that is operably connected to a pressure sensor 50. Pressure sensor 50 is operably connected to a valve 60 that is operably connected to the rotary washing bay 100 of the receiving component of the device (not shown in FIG. 1).

Also referring to FIG. 1 the cleaning medium generating system 1 comprises an electronic control box 70 that is operably connected to each of the water pump 30, the water heater 40, the pressure sensor 50 and the valve 60—such as by means of electrical leads or cables (not shown in FIG. 1).

The device of the present invention has generally two separate cycles in normal usage-namely a standby cycle and an operating cycle.

In the case of the standby cycle: the valve 60 is closed, the pump 30 delivers water from the water source 10 through the water heater 40 and pressure sensor 50. When a sufficient body of water is in the water heater 40 and the pressure sensor 50, the pump 30 turns off and encloses said body of water in the channel comprising the water heater 40 and pressure sensor 50. Upon the pump 30 turning off, the water heater 40 turns on. This action causes the body of water in said channel to vaporize and increase the pressure in the channel comprising of the water heater 40 and pressure sensor 50. The pressure sensor 50 relays the measured pressure value of said channel to the electronic control box 70. The electronic control box 70 receives this value and compares it against a preconfigured standby pressure value. If the pressure sensor 50 value exceeds the preconfigured standby pressure value, the electronic control box 70 signals to the water heater 40 to turn off. The pressure within said channel of water heater 40 and pressure sensor 50 will then fall. Once the pressure sensor 50 returns a value that does not exceed the preconfigured standby pressure value, the water heater 40 will turn on again. This cycle continues indefinitely until the cleaning medium generating system 1 is either turned off or the user initiates the operating cycle.

Figure 2:
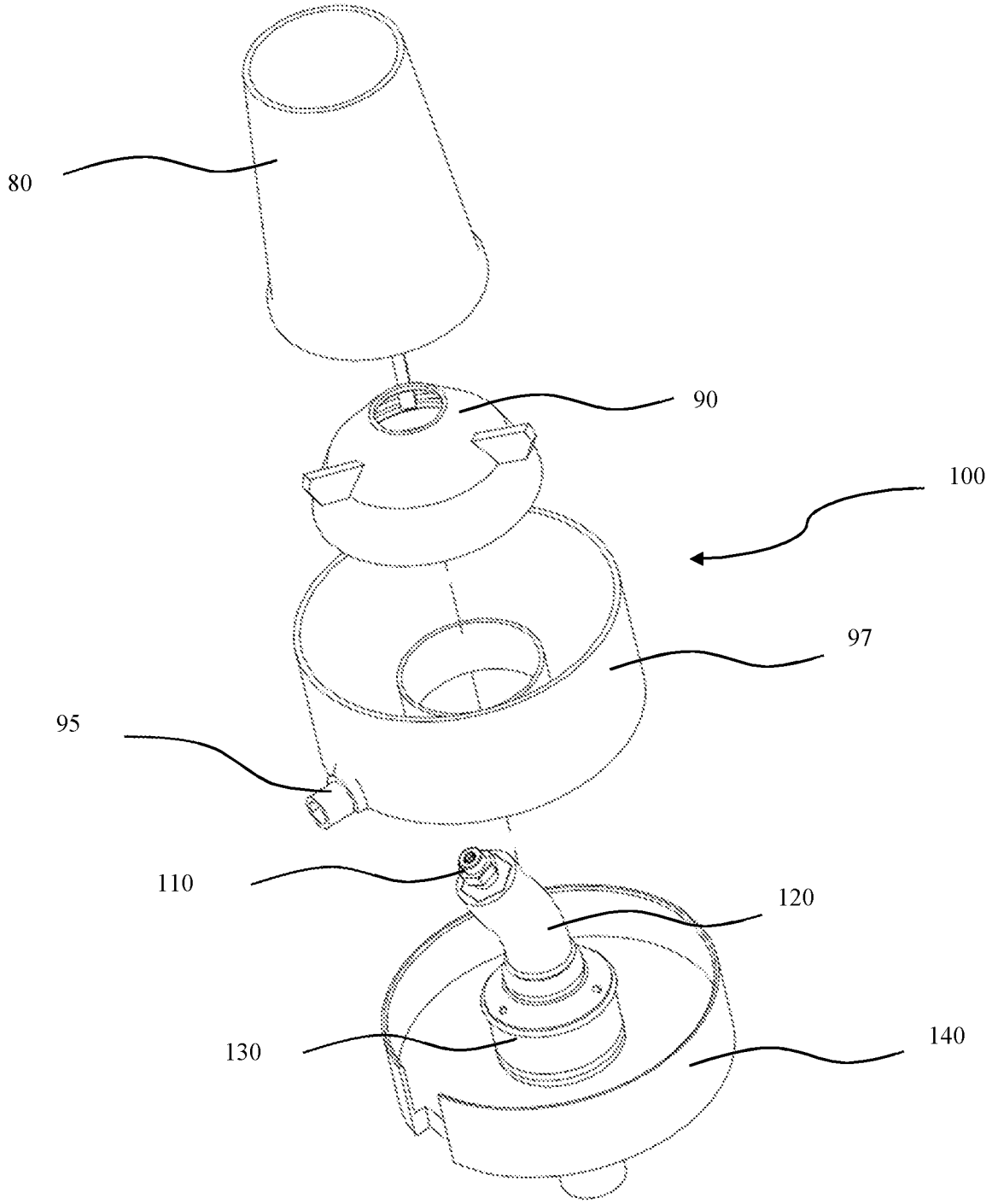
FIG. 2—which presents a view of some of the parts of the receiving component of the device of the present invention.

Referring to FIG. 2 the rotary washing bay 100 of the receiving component of the device comprises a system that rotates a rotary assembly about a stationary assembly. The rotary assembly comprises first rotating element 90, shown as an upper turntable, which operably connects to a second rotating element 130, shown as a lower turntable. The stationary assembly comprises a base plate 140, which operably connects to a drain module 97 and a shaft 120 (connection not shown). Cleaning element-shown as a nozzle 110—operably connects to the shaft 120.

The first rotating element 90 is shown as an upper turntable. This upper turntable is an example of a first rotating element that is capable of rotating the receptacle. The second rotating element 130 is shown as a lower turntable. This lower turntable is an example of a second rotating element capable of driving rotation of the first rotating element. The nozzle 110 is an example of a cleaning element. The drain module 97 is an example of a basin element. The drain outlet 95 is an example of a drain outlet for removal of spent cleaning medium.

Figure 3:
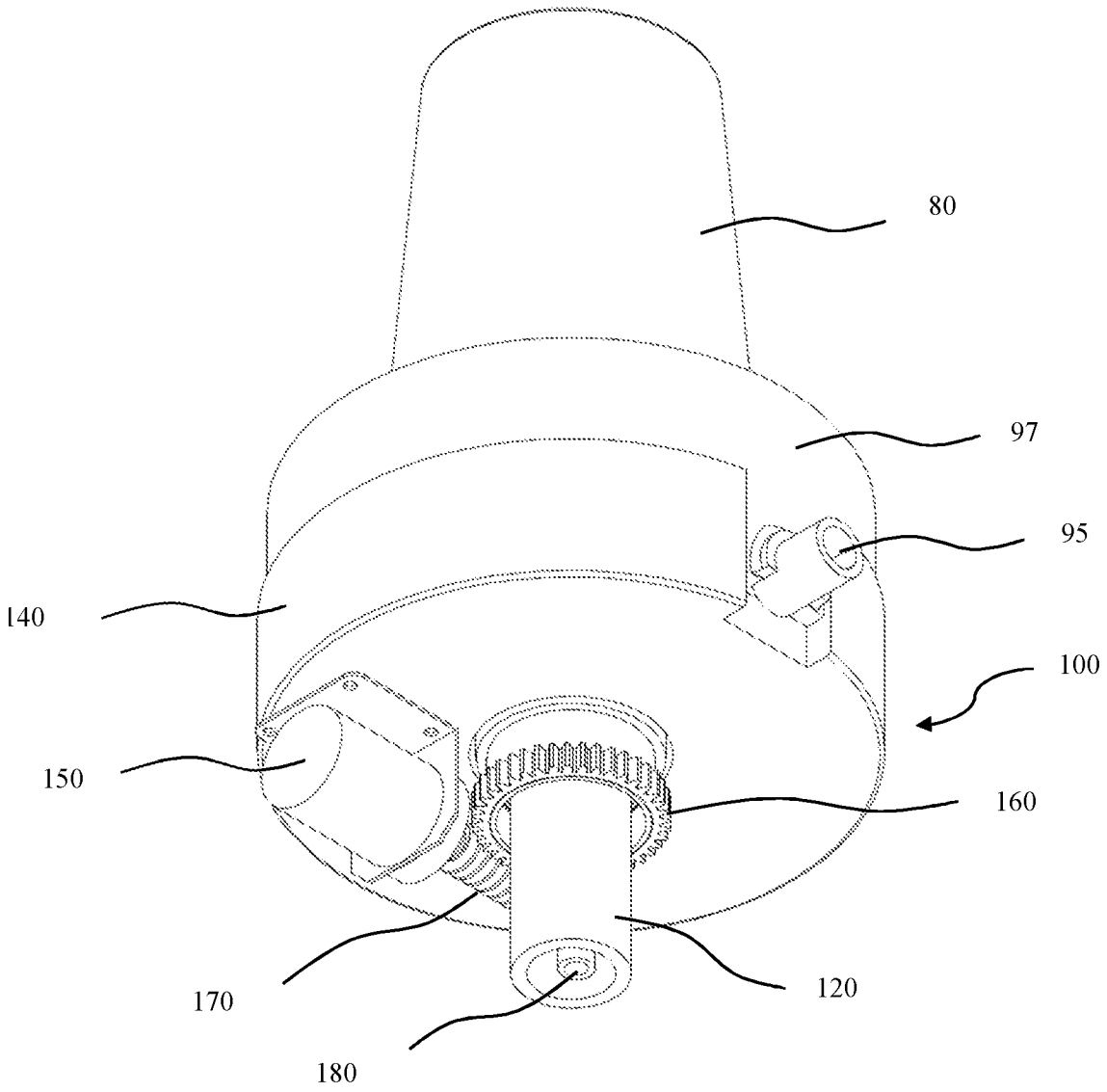
FIG. 3—which presents a view of the receiving component of the device of the present invention.

Referring to FIGS. 2 and 3, in use a receptacle, such as a beverage vessel 80, is shown to be placed into device 100. The beverage vessel 80 is placed into the receiving component, onto the first rotating element 90, shown as an upper turntable, and becomes operably connected.

Figure 4:
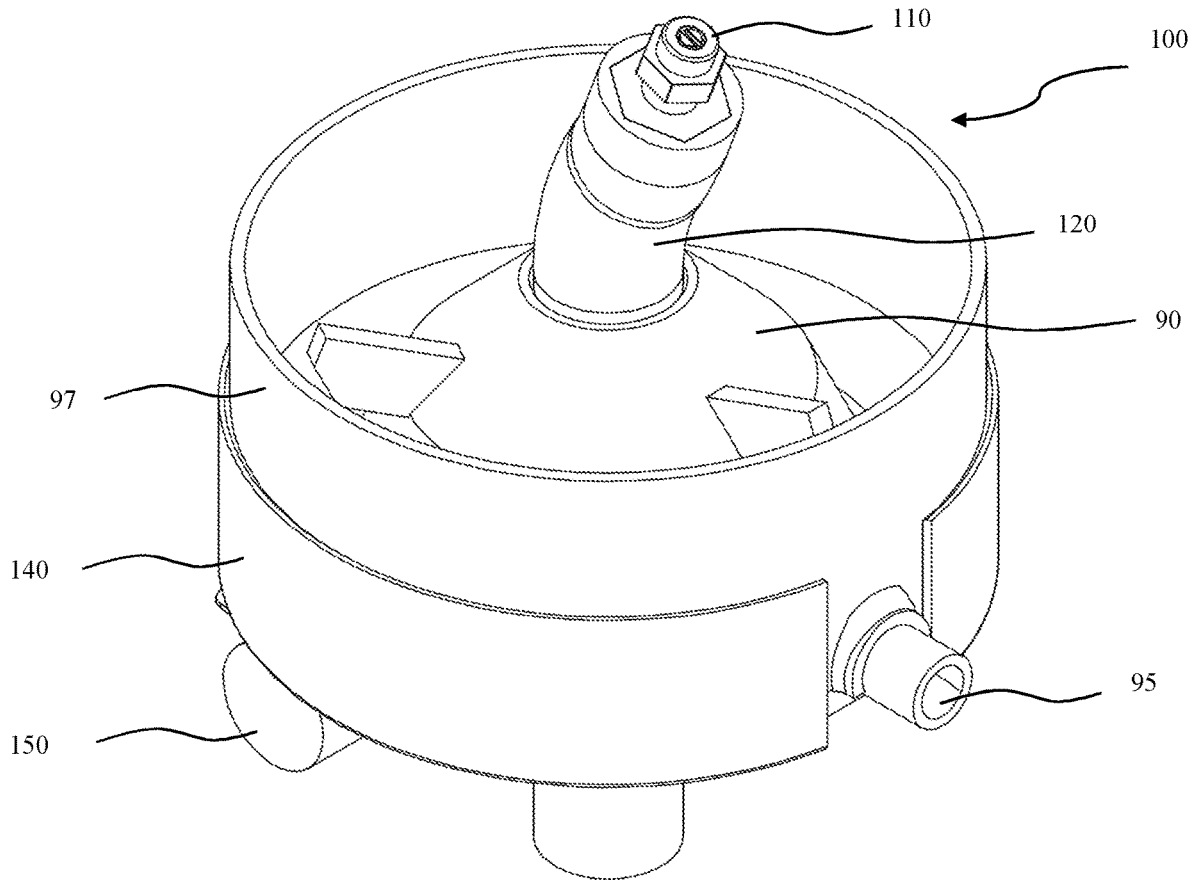
FIG. 4—which presents a view of the receiving component of the device of the present invention.

Referring to FIG. 4, the device 100 can be seen without the placement of the beverage vessel.

Figure 5:
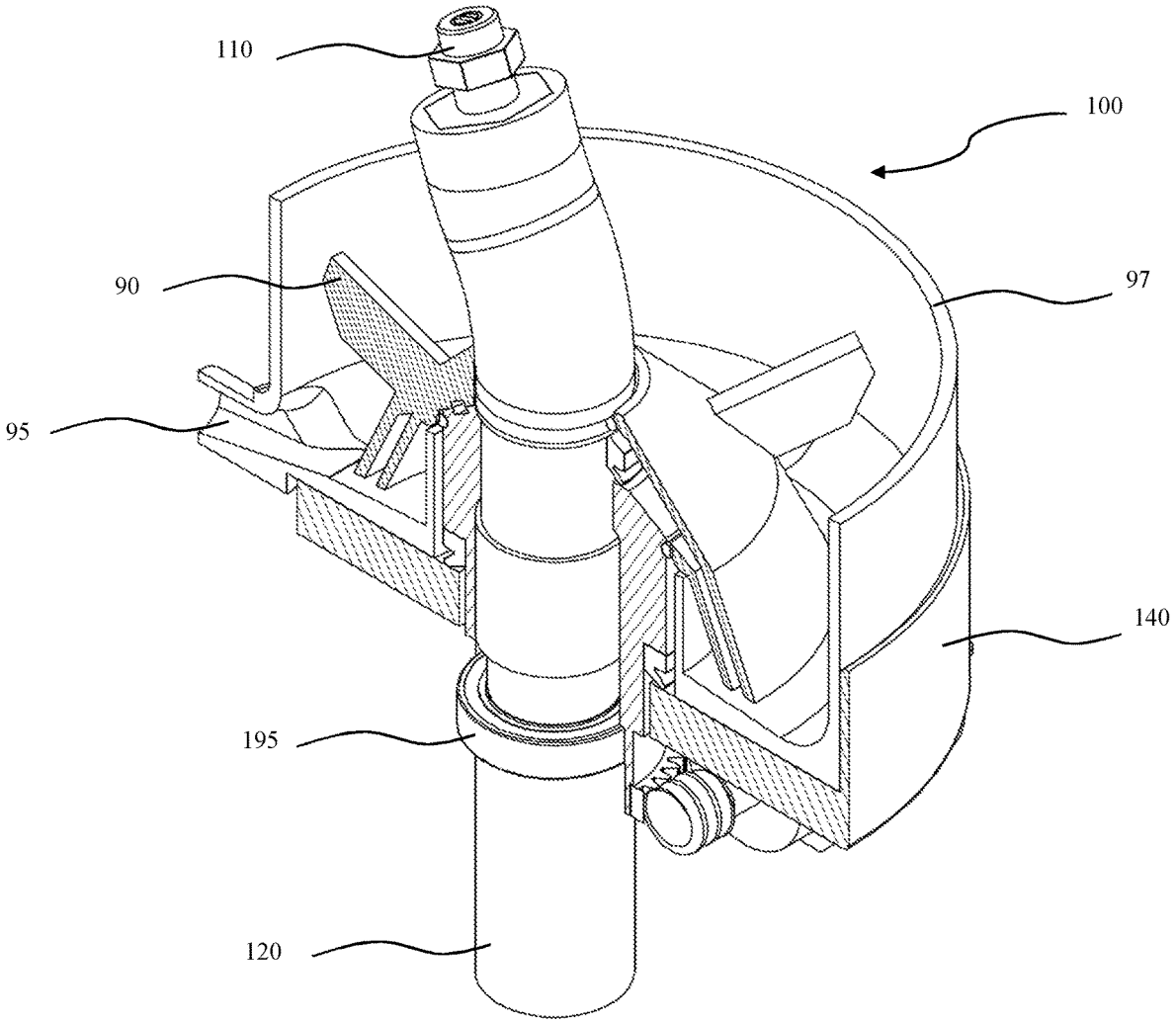
FIG. 5—which presents a part cross-sectional view of the receiving component of the device of the present invention.

Referring to FIG. 5, the rotary assembly comprises the first rotating element 90 shown as an upper turntable, which is part of the receiving component, and second rotating element 130 shown as a lower turntable. In use, the first rotating element 90 and the second rotating element 130 are rotationally driven about a bearing 195 on the stationary shaft 120 by an electric motor 150, a worm gear 170 and ring gear 160.

The gear attached to second rotating element 160 is an example of a driven gear. The worm gear 170 is an example of a drive gear. The electric motor 150 fitted with the worm gear 170 is an example of a means for driving the rotation of the second rotation element.

Referring to FIG. 6, the rotary washing bay 100 comprises a delivery hose which is operably connected to the nozzle 110 through which fluid can be delivered from device 1. The receptacle 80 is at least partly open-ended at one end 81 and having an interior space 82 defined by an interior wall 83. As can be seen from FIG. 6 the cleaning element nozzle 110 is located in the interior space 82 of the receptacle 80. The cleaning element nozzle 110 is configured to face all of the surface of at least a part of the interior wall 83 of the receptacle 80 on rotation of the receptacle 80 about its central axis by turntable 90—thereby allowing the cleaning thereof by the cleaning medium such as steam (not shown) that exits the end of the cleaning element nozzle 110.

Referring to FIG. 7, the device 200 comprises: the main body enclosure 230 which operably connects to a lid 210 which operably connects to the human user interface module 220. The cleaning medium generating system 1 and the rotary washing bay 100 are both enclosed in the casing 200.

In the case of the operating cycle, the user (not shown) will place the beverage vessel 80 into device 200, on top of the first rotating element 90, shown as an upper turntable, in the rotary washing bay 100. The user will then close the lid 210, enclosing the beverage vessel 80 within the device 200. Then the user will initiate the operating cycle by means of the human interface module 220. Upon this, the human interface module 220 sends a signal to the electronic control box 70.

The electronic control box 70 compares the current value of the pressure sensor 50 to the preconfigured operating pressure value. If the pressure sensor 50 value is lower than the preconfigured operating pressure value, the electronic control box 70 signals to the water heater 40 to turn on. Once the pressure sensor 50 value equals or exceeds the preconfigured operating pressure value, the control box 70 sends a signal simultaneously to the water pump 30 and the valve 60. The water pump 30 will turn on and the valve 60 will open. Water from the water source 10 will now be pumped constantly through the water heater 40 and vaporize to steam. This vaporised fluid continues through the now open valve 60 to the delivery hose 180, also shown in the rotary washing bay 100.

The flow of vaporised fluid travels through the delivery hose 180 to the nozzle 110 and exits the rotary washing bay 100 at high speed. The flow of vaporised fluid proceeds to remove residue from the internal face of the beverage vessel 80.

At the point the valve 60 is opened and the pump 30 is turned on, the electronic control box 70 turns on the electric motor 150. The electric motor 150 drives the worm gear 170, ring gear 160, second rotating element 130 (shown as an lower turntable), first rotating element 90 (shown as an upper turntable), and beverage vessel 80. The rotation of the beverage vessel 80 above the nozzle 110 allows the flow of vaporised fluid to remove residue from the complete circumference of the internal face of the beverage vessel 80.

The condensed waste liquid will exit the rotary washing bay 100 through the drain outlet 95 to waste collection external of the device 200 (not shown).

After a preconfigured duration, the electronic control box 70 sends a signal simultaneously to the pump 30, the water heater 40, the valve 60 and electric motor 150. The pump 30, the water heater 40 and the electric motor 150 will now turn off and the valve 60 will close. Following this the flow of vaporised fluid from the cleaning medium generating system 1 halts to the rotary washing bay 100.

Upon the halting of the flow of vaporised fluid, the user is now informed via the human user interface module 220 to open the lid 210 and remove the cleaned beverage vessel 80. This marks the end of the operating cycle. Following the end of the operating cycle, the cleaning medium generating system 1 will automatically return to the standby cycle until the next operating cycle is initiated or until the current invention is switched off.

Periodically, the human user interface module 220 will alert the user that maintenance is required. Maintenance can include the removal of the first rotating element 90, shown as an upper turntable, and drain module 97 for the user to clean externally of device 200 (not shown). The first rotating element 90 and drain module 97 can both be removed with ease from device 200. The use of seals (not shown) ensure the water tightness of the rotary washing bay 100 when the first rotating element 90 and drain module 97 are returned to the rotary washing bay 100 in preparation for normal usage.

Figure 8:
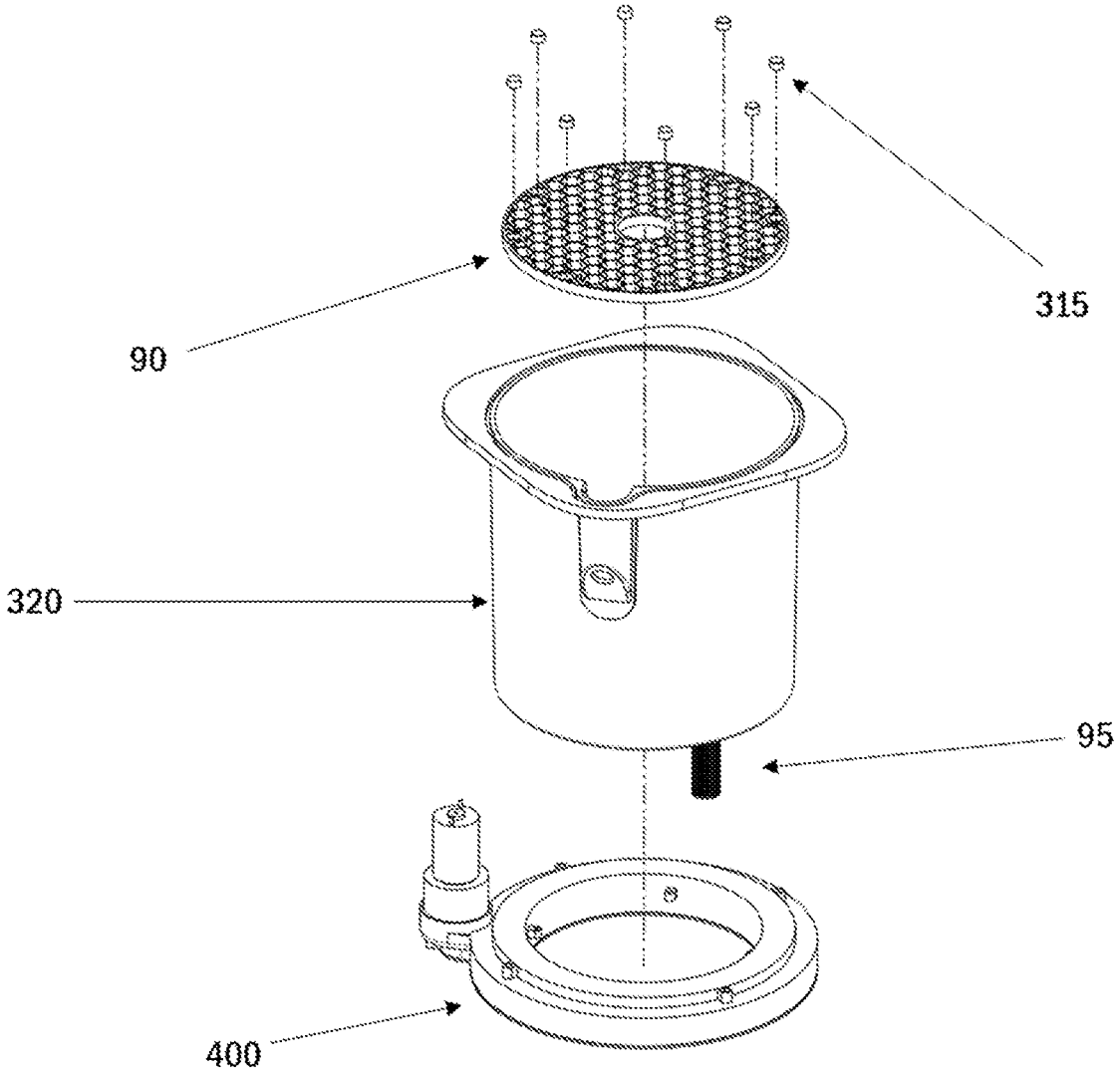
FIG. 8—which presents an expanded view of the receiving component, including the first rotating element, and the rotation driving component of a preferred embodiment the present invention.
Figure 9:
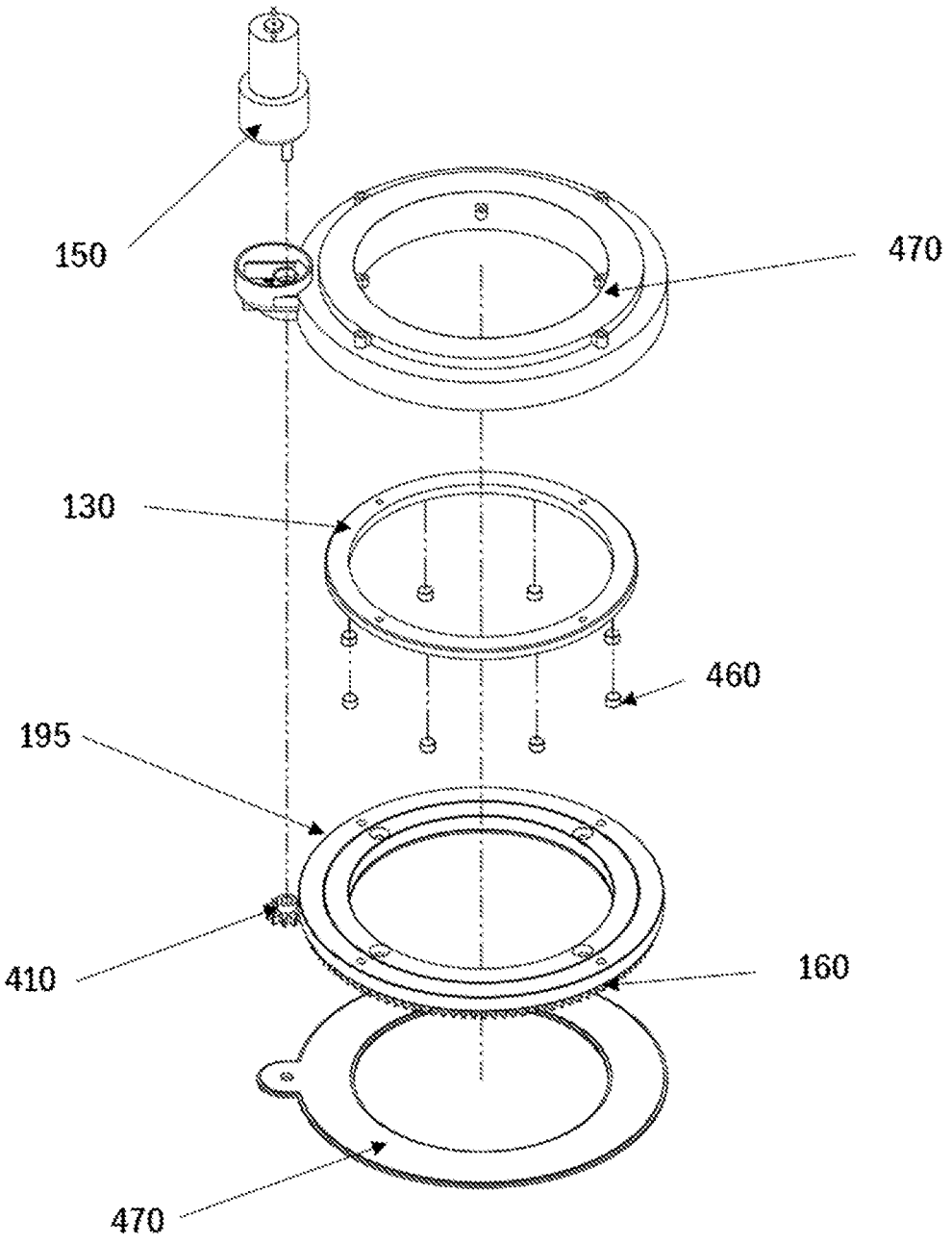
FIG. 9—which presents an expanded view of the rotation driving component of a preferred embodiment the present invention.

FIG. 8 illustrates the receiving component and rotation driving component of a preferred embodiment of the device. The device comprises a first rotating element 90, shown as an upper turntable. The first rotating element 90, shown as an upper turntable, comprises an array of magnets 315 that are sunk into first rotating element 90. The first rotating element 90, shown as an upper turntable, is magnetically coupled to the rotation driving component 400. The receiving component further comprises a basin element 320 and a drain outlet 95.

In use, the basin element 320 is capable of capturing and retaining spent cleaning medium until it drains from the basin element 320 via the drain outlet 95. As can be seen from FIG. 8, the first rotating element 90 is located within the basin element 320. The first rotating element 90, shown as an upper turntable, is able to rotate within the basin element 320 and may be removed with ease from the device by overcoming the magnetic coupling between the first rotating element 90 and the rotation driving component 400. The rotation driving component 400 is located outside of the basin element 320.

The first rotating element 90 is shown as an upper turntable. This upper turntable is an example of a first rotating element that is capable of rotating the receptacle. The basin element 320 is an example of a basin element that is capable of capturing spent cleaning medium. The drain outlet 95 is an example of a drain outlet for removal of spent cleaning medium.

Referring to FIG. 9, in a preferred embodiment the rotation driving component 400 comprises an electric motor 150, a gear attached to the motor 410, a gear attached to second rotating element 160, a bearing 195, a second rotating element 130, an array of magnets 460 and gearbox housing 470. The gear attached to the motor 410, the gear attached to second rotating element 160, the bearing 195, the second rotating element 130, and the array of magnets 460 are all located within the gearbox housing 470. The electric motor 150 is capable of rotating the gear attached to the motor 410. The gear attached to the motor 410 is operably attached to gear attached to second rotating element 160. The gear attached to the motor 410 is configured to cause rotation of gear attached to second rotating element 160 on rotation of the gear attached to the motor 410. The array of magnets 460 are mounted on the second rotating element 130. The second rotating element 130, together the array of magnets 460 mounted thereon, rotates with gear attached to second rotating element 160. Both the second rotating element 130 and gear attached to second rotating element 160 are attached to inner race of the bearing 195. The array of magnets 460 comprised in the rotation driving component 400 correspond (are of opposing polarity) to the array of magnets 315 (not shown in this figure) that are sunk into first rotating element 90 (not shown in this figure). The arrays of opposing magnets 315 (not shown in this figure), 460 are configured to cause the first rotating element 90 (not shown in this figure) to be magnetically coupled to the second rotating element 130. The arrays of opposing magnets 315 (not shown in this figure), 460 are configured to cause rotation of the first rotating element 90 on rotation of the second rotating element 130.

The second rotating element 130 is an example of second rotating element that is capable of driving rotation of the first rotating element. The arrays of opposing magnets 315, 460 are an example of a magnetic coupling. The gear attached to second rotating element 160 is an example of a driven gear. The gear attached to the motor 410 is an example of a drive gear. The electric motor 150 fitted with the gear 410 is an example of a means for driving the rotation of the second rotation element.

Figure 10:
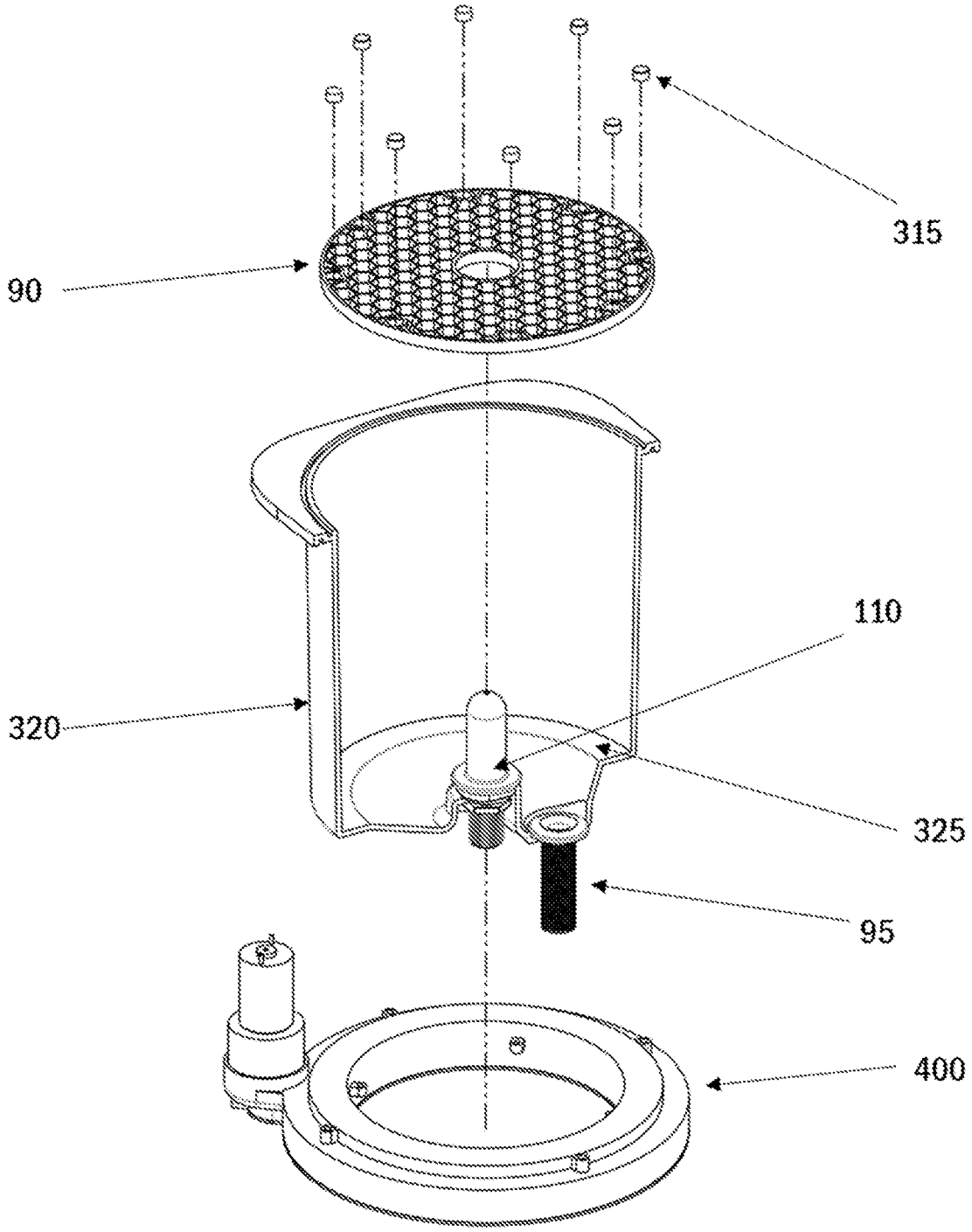
FIG. 10—which presents a part cross-sectional view the receiving component, including the first rotating element, and the rotation driving component of a preferred embodiment the present invention.
Figure 11:
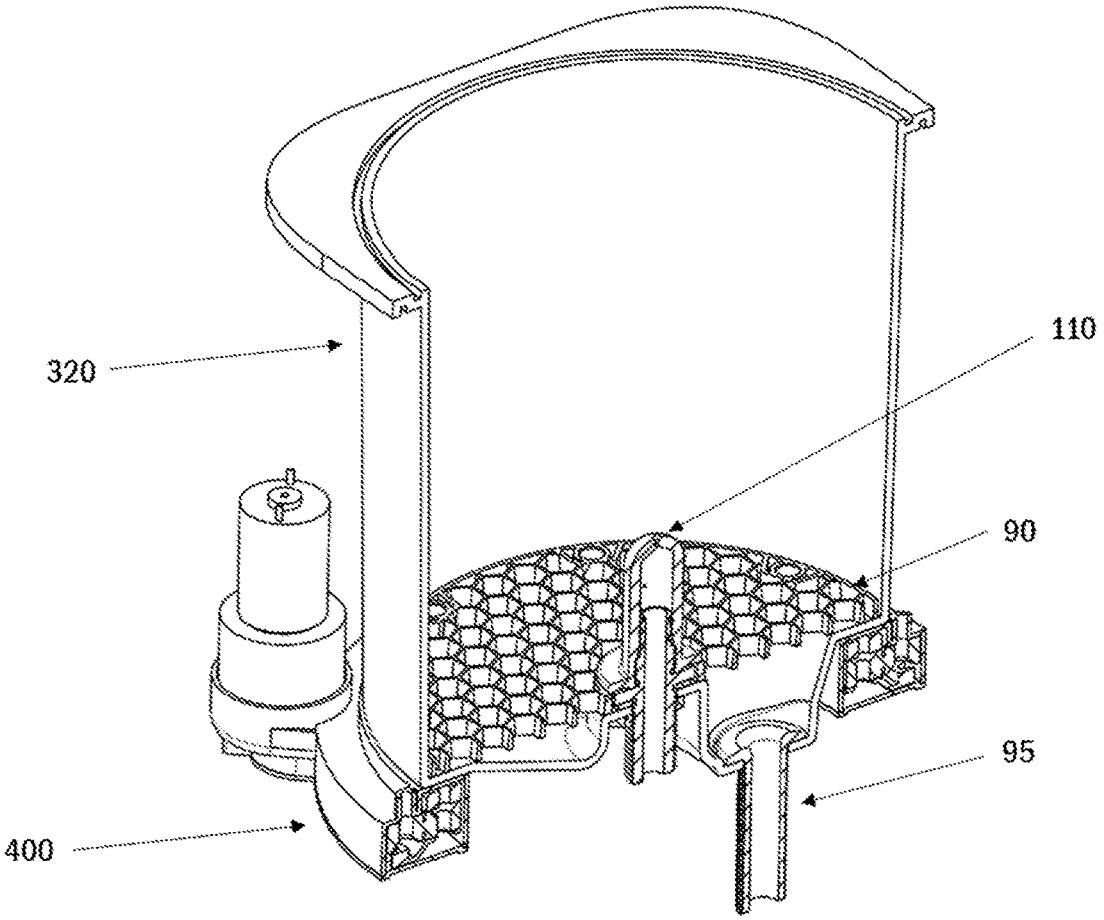
FIG. 11—which presents a cross-sectional view the receiving component, including the first rotating element, and the rotation driving component of a preferred embodiment the present invention.

Referring to FIGS. 10 and 11, the first rotating element 90, shown as an upper turntable, is mounted on a shelf 325 that offsets from the wall and base of the basin element 320. The cleaning element 110 in located within the basin element 320 and extends beyond the basin element 320 and the first rotating element 90. In use, the first rotating element 90, shown as an upper turntable, within the basin element 320 supports the receptacle 80 placed by the user.

As can be seen from FIG. 10, the cleaning element nozzle 110 is located so as it will be positioned within the interior space of a receptacle 80 in use of the specific device shown. The receptacle 80 is rotated about its central axis by first rotating element 90, shown as an upper turntable, thereby allowing the cleaning element nozzle 110 to face all of the surface of at least a part of the interior wall 83 of the receptacle 80—thereby allowing the cleaning thereof by the cleaning medium such as steam (not shown) that exits the end of the cleaning element nozzle 110.

Figure 12A:
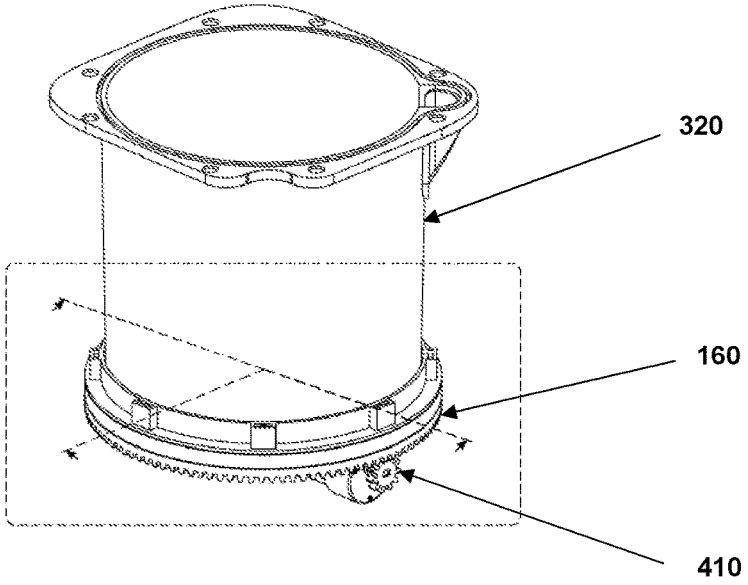
FIGS. 12A-12B—which present views of the device according to an embodiment employing a coaxial arrangement of magnets.

FIG. 12A presents a view of the device 200 where a coaxial arrangement of the magnets providing the magnetic coupling between the first rotating element 90 and the second rotating element 130 is employed. As illustrated in FIG. 12A, the device 200 has a basin element 320. As discussed above, the electric motor 150 drives a gear 410 which is mechanically connected to a gear 160 of the second rotating element 130. Rotation of the electric motor 150 therefore effects rotation of the gears 410, 160 and consequently the second rotating element 130.

Figure 12B:
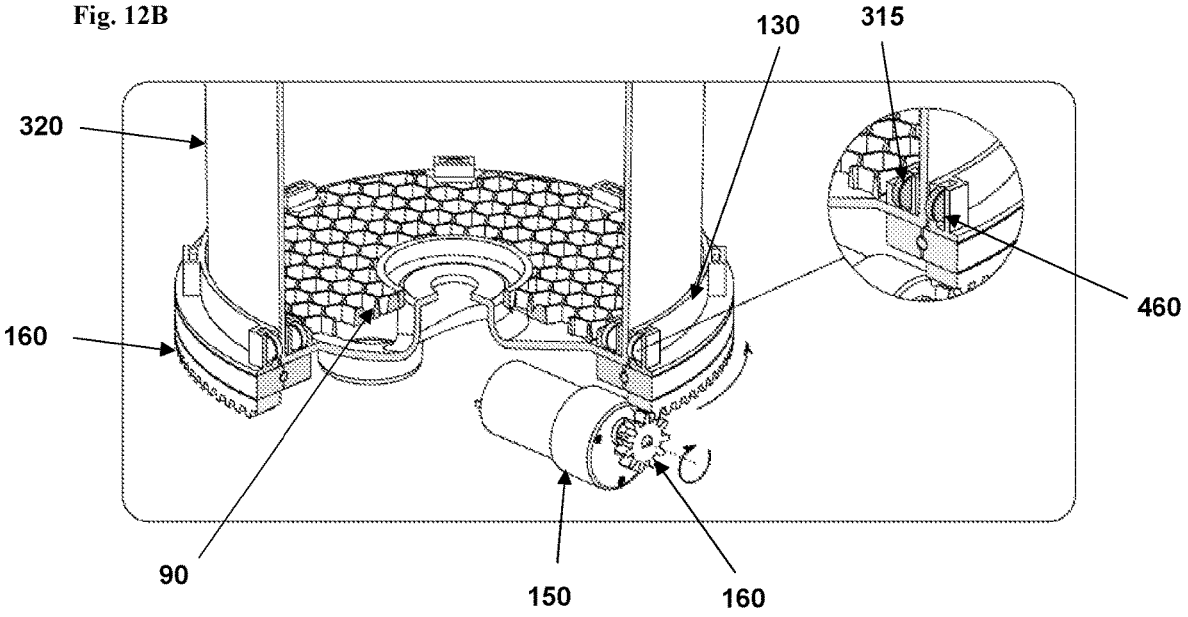

FIG. 12B shows a more detailed view of the device of FIG. 12A with the front-most section removed so that the magnetic coupling can be seen. As shown in FIG. 12B, the first rotating element 90 (here the turntable) is provided with a series of magnets 315 arranged at intervals around the circumference of the turntable 90. Disposed coaxially with respect to these magnets 315, the second rotating element 130 is provided with a set of magnets 415 at a greater radial displacement from the axis of rotation of the turntable 90. In this sense, the two sets are offset from each other in a horizontal plane (i.e., perpendicular to the axis of rotation).

Figure 13:
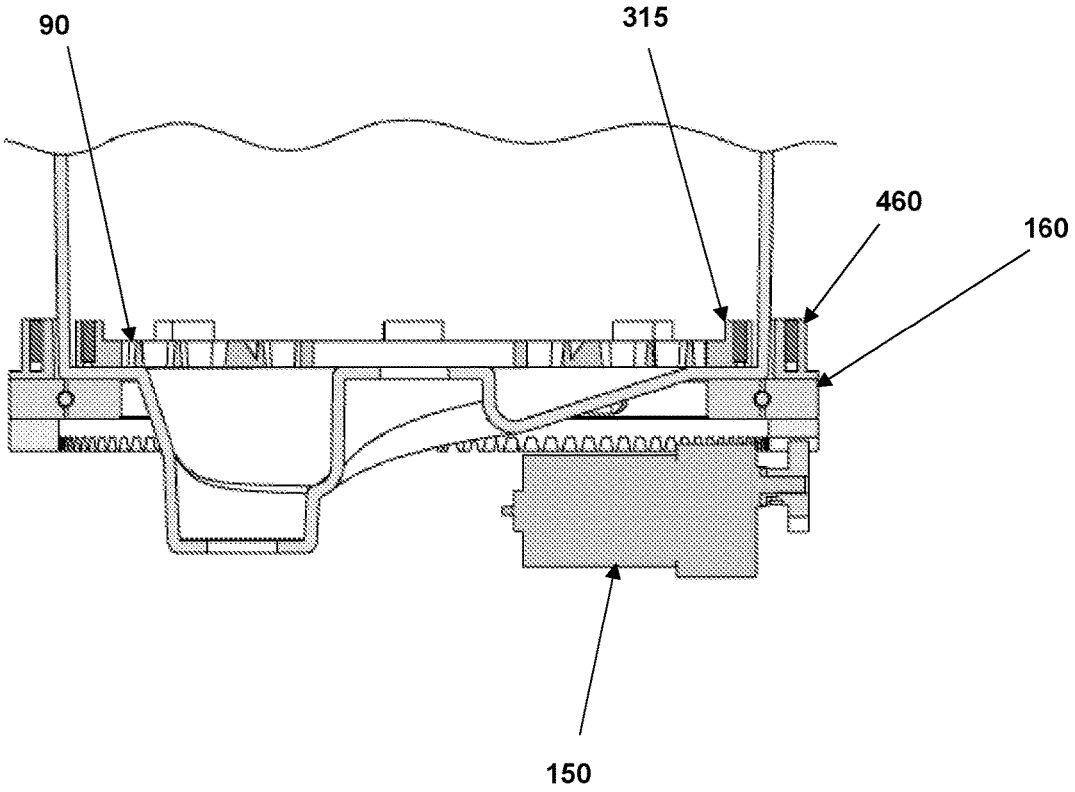
FIG. 13—which presents a cross-sectional view of the device according to the embodiment employing the coaxial arrangement of magnets.

FIG. 13 presents a cross-sectional view of the device 200 with the coaxial arrangement of magnets. In this view, it can again be seen that the two sets of magnets 315, 460 are offset from each other in a horizontal plane (i.e., coaxially). This allows the vertical height of the coupling region to be reduced since vertical space does not need to be provided to accommodate both sets of magnets one above the other.

Figure 14:
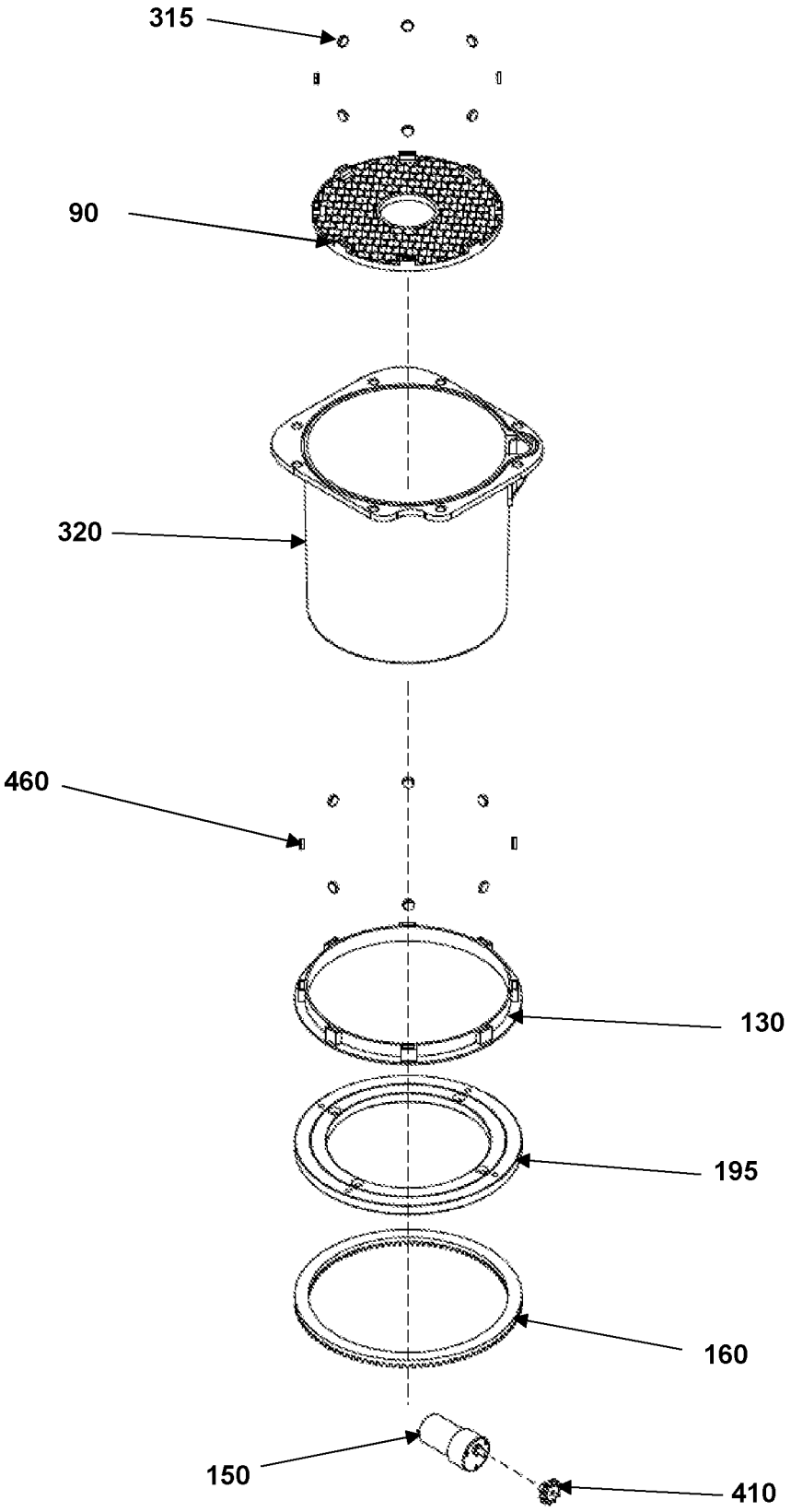
FIG. 14—which presents an expanded view of the device according to the embodiment employing the coaxial arrangement of magnets.

FIG. 14 presents an expanded view of the device 200 according to the embodiment employing the coaxial arrangement of magnets. As shown in FIG. 14, the turntable 90 is provided with a set of magnets 315 that oppose a set of magnets 460 positioned in the second rotating element 130 to form a magnetic coupling. The first and second rotating elements are arranged within a basin element 320. The second rotating element 130 is connected to a bearing 195 which permits rotation of the first and second rotating elements (and a receptacle) with respect to the rest of the device 200. An electric motor 150 is provided to drive rotation the gears 410, 160 so as to rotate the second rotating element 130 and drive rotation of the first rotating element 90.

Figure 15:
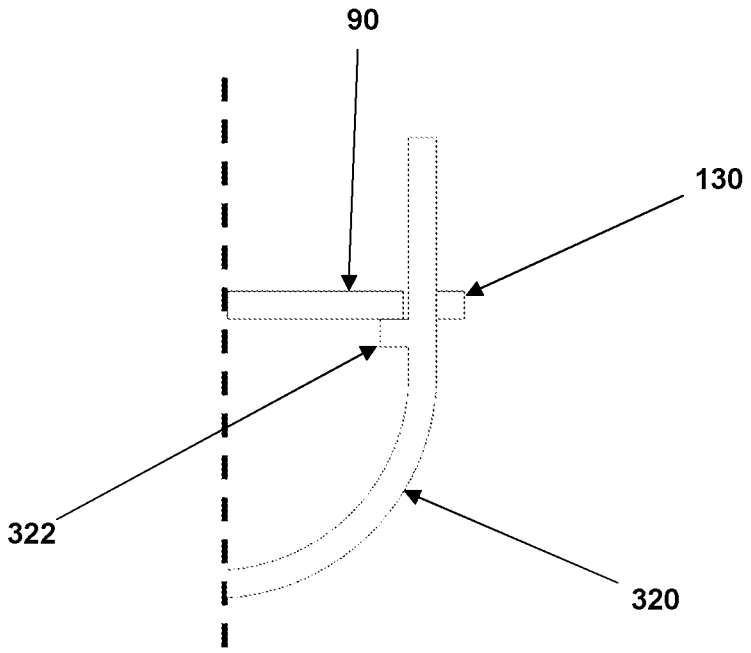
FIG. 15—which presents a cross-sectional view of the device according to the embodiment employing the coaxial arrangement of magnets.

FIG. 15 presents a cross-sectional view of the device 200 according to the embodiment employing the coaxial arrangement of magnets. As shown in FIG. 15, the basin element 320 comprises a basin shelf 322 (also referred to as a support element) on which the turntable 90 is supported. The second rotating element 130, incorporating the set of magnets 460 is disposed outside the basin element 320 in a radial direction. Since the basin shelf 322 does not need to support the two sets of magnets being positioned with an offset in the axial (vertical) direction, a small basin shelf 322 can be used. This simplifies the design of the device, improves drainage and reduces the risk of blockages.

Aspects of the present invention will now be described by way of numbered paragraphs.

1. A device for cleaning a receptacle that is at least partly open-ended at one end and having an interior space defined by an interior wall;

wherein the device is capable of cleaning at least a part of the interior wall of the receptacle;

wherein the device comprises:

(a) a receiving component for receiving and holding the receptacle to allow for the cleaning of at least the part of the interior wall of the receptacle, wherein the receiving component comprises a first rotating element that is capable of rotating the receptacle;

(b) a cleaning component that is capable of cleaning at least part of the interior wall of the receptacle interior wherein the cleaning component comprises a cleaning element that is locatable within the interior space of the receptacle when the receptacle is held by the receiving component; and (c) a rotation driving component that is capable of driving rotation of the first rotating element, wherein the rotation driving component comprises a second rotating element;

wherein the cleaning element is capable of delivering a cleaning medium to the interior wall of the receptacle to clean at least a part of the interior wall of the receptacle;

further wherein the first rotating element is coupled, preferably magnetically coupled, to the second rotating element, wherein rotation of the second rotating element is configured to cause rotation of the first rotating element on rotation of the second rotating element.

2. The device according to paragraph 1, wherein the first rotating element comprises one or more magnets and/or the second rotating element comprises one or more magnets; wherein the one or more magnets are configured to cause rotation of the first rotating element on rotation of the second rotating element.

3. The device according to paragraph 1 or paragraph 2, wherein the first rotating element comprises one or more magnets; wherein the one or more magnets are configured to cause rotation of the first rotating element on rotation of the second rotating element.

4. The device according to any one of paragraphs 1 to 3, wherein the second rotating element comprises one or more magnets; wherein the one or more magnets are configured to cause rotation of the first rotating element on rotation of the second rotating element.

5. The device according to any one of paragraphs 1 to 4, wherein the first rotating element comprises one or more magnets and the second rotating element comprises one or more corresponding, reversed polarity magnets; further wherein the one or more corresponding, reversed polarity magnets are configured to cause rotation of the first rotating element on rotation of the second rotating element.

6. The device according to any one of paragraphs 1 to 5, wherein the first rotating element comprises a plurality of magnets and the second rotating element comprises a plurality of corresponding, reversed polarity magnets; further wherein the plurality of corresponding, reversed polarity magnets are configured to cause rotation of the first rotating element on rotation of the second rotating element.

7. The device according to any one of paragraphs 1 to 6, wherein the first rotating element and the second rotating element comprise the same number of magnets.

8. The device according to any one of paragraphs 1 to 7, wherein the first rotating element comprises two magnets and the second rotating element comprises two corresponding, reversed polarity magnets, wherein the corresponding magnets are configured to cause rotation of the first rotating element on rotation of the second rotating element.
9. The device according to any one of paragraphs 1 to 8, wherein the first rotating element comprises three magnets and the second rotating element comprises three corresponding, reversed polarity magnets, wherein the corresponding magnets are configured to cause rotation of the first rotating element on rotation of the second rotating element.
10. The device according to any one of paragraphs 1 to 9, wherein the first rotating element comprises four magnets and the second rotating element comprises four corresponding, reversed polarity magnets, wherein the corresponding magnets are configured to cause rotation of the first rotating element on rotation of the second rotating element.
11. The device according to any one of paragraphs 1 to 10, wherein the first rotating element comprises five magnets and the second rotating element comprises five corresponding, reversed polarity magnets, wherein the corresponding magnets are configured to cause rotation of the first rotating element on rotation of the second rotating element.
12. The device according to any one of paragraphs 1 to 11, wherein the first rotating element comprises six magnets and the second rotating element comprises six corresponding, reversed polarity magnets, wherein the corresponding magnets are configured to cause rotation of the first rotating element on rotation of the second rotating element.
13. The device according to any one of paragraphs 1 to 12, wherein the first rotating element comprises more than six magnets and the second rotating element comprises more than six corresponding, reversed polarity magnets, wherein the corresponding magnets are configured to cause rotation of the first rotating element on rotation of the second rotating element.
14. The device according to any one of paragraphs 1 to 13, wherein obstruction or prevention of the rotation of the first rotating element does not prevent rotation of the second rotating element.
15. The device according to any one of paragraphs 1 to 14, wherein the first rotating element is capable of disengaging and/or slipping from the second rotating element.
16. The device according to any one of paragraphs 1 to 15, wherein the first rotating element disengages and/or slips from the second rotating element when there is a force opposing the rotation of the first rotating element.
17. The device according to any one of paragraphs 1 to 16, wherein the first rotating element disengages and/or slips from the second rotating element when there is a force opposing the rotation of the first rotating element that exceeds the force of the magnetic coupling between the first rotating element and the second rotating element.
18. The device according to any one of paragraphs 1 to 17, wherein the first rotating element disengages and/or slips from the second rotating element when a force of about 5 Newton-centimetres or more is applied at the pivot point of the first rotating element.
19. The device according to any one of paragraphs 1 to 18, wherein the first rotating element disengages and/or slips from the second rotating element when a force of about 10 Newton-centimetres or more is applied at the pivot point of the first rotating element.
20. The device according to any one of paragraphs 1 to 19, wherein the first rotating element disengages and/or slips from the second rotating element when a force of about 30 Newton-centimetres or more is applied at the pivot point of the first rotating element.
21. The device according to any one of paragraphs 1 to 20, wherein the first rotating element disengages and/or slips from the second rotating element when a force of about 50 Newton-centimetres or more is applied at the pivot point of the first rotating element.
22. The device according to any one of paragraphs 1 to 21, wherein the first rotating element disengages and/or slips from the second rotating element when a force of about 100 Newton-centimetres or more is applied at the pivot point of the first rotating element.
23. The device according to any one of paragraphs 1 to 22, wherein the first rotating element disengages and/or slips from the second rotating element when a force of less than about 3000 Newton-centimetres or more is applied at the pivot point of the first rotating element.
24. The device according to any one of paragraphs 1 to 23, wherein the first rotating element disengages and/or slips from the second rotating element when a force of less than about 1000 Newton-centimetres or more is applied at the pivot point of the first rotating element.
25. The device according to any one of paragraphs 1 to 24, wherein the first rotating element disengages and/or slips from the second rotating element when a force of less than about 500 Newton-centimetres or more is applied at the pivot point of the first rotating element.
26. The device according to any one of paragraphs 1 to 25, wherein the first rotating element disengages and/or slips from the second rotating element when a force of less than about 300 Newton-centimetres or more is applied at the pivot point of the first rotating element.
27. The device according to any one of paragraphs 1 to 26, wherein the first rotating element disengages and/or slips from the second rotating element when a force of less than about 200 Newton-centimetres or more is applied at the pivot point of the first rotating element.
29. The device according to any one of paragraphs 1 to 17, wherein the first rotating element disengages and/or slips from the second rotating element when a force of about 30 Newton-centimetres to about 500 Newton-centimetres is applied at the pivot point of the first rotating element.
30. The device according to any one of paragraphs 1 to 17, wherein the first rotating element disengages and/or slips from the second rotating element when a force of 50 Newton-centimetres to 300 Newton-centimetres is applied at the pivot point of the first rotating element.
31. The device according to any one of paragraphs 1 to 17, wherein the first rotating element disengages and/or slips from the second rotating element when a force of about 200 Newton-centimetres to about 300 Newton-centimetres is applied at the pivot point of the first rotating element.
32. The device according to any one of paragraphs 1 to 31, wherein the disengaging and/or slipping of the first rotating element from the second rotating element results in the speed of rotation of the first rotating element (measured in revolutions per minute or RPM) falling below the speed of rotation of the second rotating element.

33. The device according to any one of paragraphs 1 to 32, wherein the disengaging and/or slipping of the first rotating element from the second rotating element results in the first rotating element ceasing to rotate.

34. The device according to any one of paragraphs 1 to 33, wherein the first rotating element will re-engage with the second rotating element when the force opposing the rotation of the first rotating element falls below the force of the magnetic coupling between the first rotating element and the second rotating element.

35. The device according to any one of paragraphs 1 to 34, wherein the device does not comprise a mechanical connection between the first rotating element and the second rotating element.

36. The device according to any one of paragraphs 1 to 35, wherein the device does not comprise a mechanical connection between the first rotating element and any other part of the device.

37. The device according to any one of paragraphs 1 to 36, wherein the first rotating element can be removed from the device by overcoming the magnetic coupling to the second rotating element.

38. The device according to any one of paragraphs 1 to 37, comprising a watertight barrier between the first rotating element and the second rotating element.

39. The device according to any one of paragraphs 1 to 38, wherein the receiving component of the device comprises a basin element that is capable of capturing spent cleaning medium.

40. The device according to paragraph 39, wherein the second rotating element is locatable outside of the basin element.

41. The device according to paragraph 39 or paragraph 40, wherein at least part of the basin element is locatable between the first rotating element and the second rotating element.

42. The device according to any one of paragraphs 1 to 41, wherein the cleaning element faces a part of the interior wall of the receptacle.

43. The device according to any one of paragraphs 1 to 42, wherein the first rotating element is capable of allowing rotation of the interior wall of the receptacle relative to the cleaning element.

44. The device according to any one of paragraphs 1 to 43, wherein the cleaning element is in a fixed position.

45. The device according to any one of paragraphs 1 to 44 wherein at least a part of the cleaning component is located within the receiving component.

46. The device according to any one of paragraphs 1 to 45 wherein the cleaning element extends beyond the receiving component.

47. The device according to any one of paragraphs 1 to 46 wherein the receiving component comprises a turntable element capable of rotating the receptacle and wherein the cleaning element extends beyond the turntable element.

48. The device according to any one of paragraphs 1 to 47, wherein the rotation driving component comprises a means for driving the rotation of the second rotation element.

49. The device according to paragraph 48 wherein the means for driving the rotation of the second rotation element comprises a motor, optionally wherein the motor is an electric motor.

50. The device according to paragraph 48, wherein the means for driving the rotation of the second rotation element comprises a motor fitted with a drive gear.

51. The device according to paragraphs 50, wherein the second rotating element comprises a driven gear, further wherein the driven gear is operably connected to the drive gear wherein the drive gear is configured to cause rotation of the driven gear on rotation of the drive gear.

52. The device according to paragraph 50 wherein the drive gear has a diameter that is less than the diameter of the second rotating element gear.

53. The device according to any one of paragraphs 50 to 52, wherein the rotation driving component further comprises a controller for the motor, wherein the controller allows for the rotational speed of the first rotating element to be altered.

54. The device according to any one of paragraphs 1 to 53, wherein the receiving component and/or the cleaning component comprises a drain outlet for removal of spent cleaning medium.

55. The device according to any one of paragraphs 1 to 54, wherein the basin element comprises a drain outlet for removal of spent cleaning medium.

56. The device according to any one of paragraphs 1 to 55, wherein the basin element comprises a drain outlet for removal of spent cleaning medium and wherein the cleaning component comprises a drain closure element.

57. The device according to any one of paragraphs 1 to 56, wherein the cleaning component comprises a cleaning medium preparation element that is operably connected to the cleaning element.

58. The device according to any one of paragraphs 1 to 57, wherein the device is capable of cleaning at least all of the interior base of the receptacle.

59. The device according to any one of paragraphs 1 to 58, wherein the device is capable of cleaning all of the interior wall of the receptacle.

60. The device according to any one of paragraphs 1 to 59, wherein the cleaning element comprises a nozzle through which the cleaning medium passes onto the interior wall of the receptacle.

61. The device according to any one of paragraphs 1 to 60, wherein the cleaning medium comprises heated water.

62. The device according to any one of paragraphs 1 to 61, wherein the cleaning medium comprises steam.

63. A device according to any one of paragraphs 1 to 62, wherein the device further comprises a user interface module to allow a user to use the device.

64. A device according to any one of paragraphs 1 to 63, wherein the cleaning component and the receiving component are housed in an integral unit.

65. A device according to any one of paragraphs 1 to 64, wherein the cleaning component and the receiving component are housed in an integral unit; and wherein the device further comprises a user interface module to allow a user to use the device; wherein the user interface module is located on one wall of the user interface module.

66. A device according to any one of paragraphs 63 to 65, wherein the user interface module allows for the rotational speed of the first rotating device to be altered.

67. A device according to paragraph 66, wherein the user interface module allows for different rotational speeds according to the pre-programmed cycle that the user selects.

68. The device according to any one of paragraphs 1 to 67, wherein the device is capable of cleaning one or more receptacles.
69. The device according to any one of paragraphs 1 to 68, wherein the device is configured to clean one receptacle at a time.
70. The device according to any one of paragraphs 1 to 69, wherein the receptacle is open-ended at one end.
71. The device according to any one of paragraphs 1 to 70, wherein the receptacle is a receptacle for a beverage.
72. The device according to any one of paragraphs 1 to 71, wherein the receptacle is a receptacle for a coffee beverage.
73. The device according to any one of paragraphs 1 to 72, wherein the receptacle is cleaned by the device in a period of less than about 30 seconds.
74. The device according to any one of paragraphs 1 to 73, wherein the receptacle is cleaned by the device in a period of less than about 25 seconds.
75. The device according to any one of paragraphs 1 to 74, wherein the receptacle is cleaned by the device in a period of less than about 20 seconds.
76. The device according to any one of paragraphs 1 to 75, wherein the receptacle is cleaned by the device in a period of less than about 15 seconds.
77. The device according to any one of paragraphs 1 to 76, wherein the receptacle is cleaned by the device in a period of about 10 seconds or less than about 10 seconds.
78. A device for cleaning a receptacle that is at least partly open-ended at one end and having an interior space defined by an interior wall;

wherein the device is capable of cleaning at least a part of the interior wall of the receptacle;

wherein the device comprises (a) a receiving component for receiving and holding the receptacle to allow for the cleaning of at least the part of the interior wall of the receptacle, wherein the receiving component comprises a first rotating element that is capable of rotating the receptacle;

(b) a cleaning component that is capable of cleaning at least part of the interior wall of the receptacle interior wherein the cleaning component comprises a cleaning element that is locatable within the interior space of the receptacle when the receptacle is held by the receiving component; and (c) a rotation driving component that is capable of driving rotation of the first rotating element, wherein the rotation driving component comprises a second rotating element;

wherein the cleaning element is capable of delivering a cleaning medium to the interior wall of the receptacle to clean at least a part of the interior wall of the receptacle;

further wherein the first rotating element is magnetically coupled to the second rotating element wherein the second rotating element is configured to cause rotation of the first rotating element on rotation of the second rotating element;

further wherein the first rotating element disengages and/or slips from the second rotating element when a force of about 50 Newton-centimetres to about 300 Newton-centimetres is applied at the pivot point of the first rotating element;

further wherein the first rotating element disengages and/or slips from the second rotating element when there is a force opposing the rotation of the first rotating element that exceeds the force of the magnetic coupling between the first rotating element and the second rotating element;

further wherein the device does not comprise a mechanical connection between the first rotating element and the second rotating element;

further wherein the receiving component comprises a basin element that is capable of capturing spent cleaning medium;

further wherein the second rotating element is locatable outside of the basin element;

further wherein the cleaning element faces a part of the interior wall of the receptacle;

further wherein the first rotating element comprises a turntable element that is capable of rotating the receptacle and wherein the cleaning element extends beyond the turntable element;

further wherein the basin element comprises a drain outlet for removal of spent cleaning medium.

79. A method of cleaning a receptacle that is at least partly open-ended at one end and having an interior space defined by an interior wall comprising use of the device according to any one of paragraphs 1 to 78; wherein a receptacle is placed on the receiving component of the device and the cleaning component cleans at least part of the interior wall of the receptacle interior.
80. A method according to paragraph 79 wherein receptacle is open-ended at one end.
81. A method according to paragraph 79 or paragraph 80 wherein the receptacle is a receptacle for a beverage.
82. A method according to any one of paragraphs 79 to 81 wherein the receptacle is a receptacle for a coffee beverage.
83. A method according to any one of paragraphs 79 to 82 wherein the receptacle is cleaned by the device in a period of less than about 30 seconds.
84. A method according to any one of paragraphs 79 to 83 wherein the receptacle is cleaned by the device in a period of less than about 25 seconds.
85. A method according to any one of paragraphs 79 to 84 wherein the receptacle is cleaned by the device in a period of less than about 20 seconds.
86. A method according to any one of paragraphs 79 to 85 wherein the receptacle is cleaned by the device in a period of less than about 15 seconds.
87. A method according to any one of paragraphs 79 to 86 wherein the receptacle is cleaned by the device in a period of about 10 seconds or less than about 10 seconds.
88. A device substantially as described herein and with reference to any one or more of FIGS. 1 to 11.
89. A method substantially as described herein and with reference to any one or more of FIGS. 1 to 11.

Additional aspects of the present invention will now be described by way of numbered paragraphs.

1. A device capable of cleaning a single receptacle, or a plurality of receptacles, such as a beverage vessel, in a very short period of time.
2. A device according to paragraph 1 wherein a person may place a single, or a plurality of receptacles into said device to clean the receptacle in a short period of time.
3. A device according to paragraphs 1 or 2 which makes use of a hot water generating system to clean the receptacle within said device in a period of less than 30 seconds, preferably less than about 25 seconds, preferably less than about 20 seconds, preferably less than about 15 seconds, preferably less than about 10 seconds.

4. A device according to any one of paragraphs 1 to 3 which makes use of a steam generating system to clean the receptacle within said device in a period of less than 30 seconds, preferably less than about 25 seconds, preferably less than about 20 seconds, preferably less than about 15 seconds, preferably less than about 10 seconds.
5. A device according to any one of paragraphs 1 to 4 wherein said device is configured to allow a single receptacle to be received onto a receiving component capable of rotary motion to facilitate the device's washing function.
6. A device according to any one of paragraphs 1 to 5 wherein the device is compact thereby allowing it to be used in any location, in particular a retail or office space, or even at a home.
7. A device according to any one of paragraphs 1 to 6 wherein the device is configured to wash a variety of receptacles including cups, beakers, mugs, glasses, temporary food storage receptacles (Tupperware®) and the like.
8. A device according to any one of paragraphs 1 to 7 wherein the device comprises a human user interface component preferably being in the form of a display and/or button.
9. A method of cleaning a single receptacle, or a plurality of receptacles in a short period of time; said method comprising using the device according to any of the paragraphs 1 to 8.

Even further additional aspects of the invention will now be described by way of numbered clauses.

1. A device (200) for cleaning a receptacle (80) that is at least partly open-ended at one end (81) and having an interior space (82) defined by an interior wall (83);

wherein the device is capable of cleaning at least a part of the interior wall of the receptacle (80);

wherein the device comprises (a) a receiving component for receiving and holding the receptacle (80) to allow for the cleaning of at least the part of the interior wall of the receptacle (80), wherein the receiving component comprises a first rotating element (90) that is capable of rotating the receptacle (80);

(b) a cleaning component that is capable of cleaning at least part of the interior wall of the receptacle interior wherein the cleaning component comprises a cleaning element (110) that is locatable within the interior space of the receptacle (80) when the receptacle (80) is held by the receiving component; and (c) a rotation driving component (400) that is capable of driving rotation of the first rotating element (90), wherein the rotation driving component comprises a second rotating element (130);

wherein the cleaning element is capable of delivering a cleaning medium to the interior wall of the receptacle (80) to clean at least a part of the interior wall of the receptacle (80);

further wherein the first rotating element (90) is magnetically coupled to the second rotating element (130), wherein the second rotating element (130) is configured to cause rotation of the first rotating element (90) on rotation of the second rotating element (130).

2. The device according to clause 1, wherein the first rotating element (90) comprises one or more magnets (315) and/or the second rotating element (130) comprises one or more magnets (460); wherein the one or more magnets (315), (460) is configured to cause rotation of the first rotating element (90) on rotation of the second rotating element (130).
3. The device according to clause 2, wherein the first rotating element (90) comprises one or more magnets (315) and the second rotating element (130) comprises one or more corresponding, reversed polarity magnets (460); wherein the one or more corresponding, reversed polarity magnets (315), (460) are configured to cause rotation of the first rotating element (90) on rotation of the second rotating element (130).
4. The device according to any one of clauses 1 to 3, wherein the first rotating element (90) is capable of disengaging and/or slipping from the second rotating element (130).
5 The device according to any one of clauses 1 to 4, wherein the first rotating element (90) disengages and/or slips from the second rotating element (130) when there is a force opposing the rotation of the first rotating element (90) that exceeds the force of the magnetic coupling between the first rotating element (90) and the second rotating element (130).
6. The device according to any one of clauses 1 to 5, wherein the first rotating element (90) disengages and/or slips from the second rotating element (130) when a force of less than about 300 Newton-centimetres or more is applied at the pivot point of the first rotating element (90).
7. The device according to any one of clauses 1 to 6, wherein the first rotating element (90) disengages and/or slips from the second rotating element (130) when a force of about 50 Newton-centimetres to about 300 Newton-centimetres is applied at the pivot point of the first rotating element (90).
8. The device according to any one of clauses 1 to 7, wherein the device does not comprise a mechanical connection between the first rotating element (90) and the second rotating element (130).
9. The device according to any one of clauses 1 to 8, wherein the device does not comprise a mechanical connection between the first rotating element (90) and any other part of the device (200).
10. The device according to any one of clauses 1 to 9, wherein the device comprises a watertight barrier between the first rotating element (90) and the second rotating element (130).
11. The device according to any one of clauses 1 to 10, wherein the receiving component of the device comprises a basin element (320) that is capable of capturing spent cleaning medium.
12. The device according to clause 11, wherein the second rotating element (130) is locatable outside of the basin element (320).
13. The device according to any one of clauses 1 to 11, wherein the cleaning element (110) faces a part of the interior wall (83) of the receptacle (80).
14. The device according to any one of clauses 1 to 13, wherein the first rotating element (90) comprises a turntable element that is capable of rotating the receptacle (80) and wherein the cleaning element (110) extends beyond the turntable element.
15. The device according to any one of clauses 1 to 14, wherein the rotation driving component (400) further comprises a means for driving the rotation of the second rotation element (130).

16. The device according to clause 15, wherein the means for driving the rotation of the second rotating element (130) comprises a motor (150).
17. The device according to any one of clauses 1 to 16 wherein the basin element (320) comprises a drain outlet for removal of spent cleaning medium (95).
18. The device according to any one of clauses 1 to 16 wherein the cleaning component comprises a cleaning medium preparation element (1) that is operably connected to the cleaning element (110).
19. The device according to any one of clauses 1 to 17 wherein the cleaning medium comprises steam.
20. The device according to any one of clauses 1 to 18 wherein the device further comprises a user interface module (200) to allow a user to use the device.
21. The device according to clause 20, wherein the user interface module (200) allows for the rotational speed of the first rotating device (90) to be altered.
22. The device according to any one of clauses 1 to 21 wherein the receptacle (80) is cleaned by the device in a period of about 30 seconds or less than about 30 seconds.
23. A method of cleaning a receptacle (80) that is at least partly open-ended at one end (81) and having an interior space (82) defined by an interior wall (83) comprising use of the device according to any one of clauses 1 to 22; wherein a receptacle (80) is placed on the receiving component of the device and the cleaning component cleans at least part of the interior wall (83) of the receptacle interior (82).
24. A method according to clause 23 wherein the receptacle (80) is a receptacle for a beverage.
25. A method according to clause 23 or clause 24 wherein the receptacle (80) is cleaned by the device in a period of about 30 seconds or less than about 30 seconds.

Although the invention has been described above with respect to a preferred embodiment and various modifications thereof, it is apparent that the foregoing and other changes in form and detail may be made therein by one skilled in the art while still remaining within the spirit and scope of the invention.

The invention claimed is:

1. A device (200) for cleaning a receptacle (80), wherein the device (200) comprises:

a receiving component for receiving and holding the receptacle (80), wherein the receiving component comprises a first rotating element (90) that is capable of rotating the receptacle (80);

a nozzle (110) arranged to be directed at an interior of the receptacle (80) when the receptacle (80) is held by the receiving component; and a rotation driving component (400) comprising a second rotating element (130), wherein the rotation driving component (400) is arranged to drive rotation of the second rotating element (130);

wherein the second rotating element (130) is magnetically coupled to the first rotating element (90) such that rotation of the second rotating element (130) by the rotation driving component (400) drives rotation of the first rotating element (90).

2. The device (200) according to claim 1, wherein the receptacle is at least partly open ended at one end (81) and having an interior space (82) defined by an interior wall (83); wherein the device is capable of cleaning at least a part of the interior wall of the receptacle (80), wherein the nozzle (80) is located within an interior space of the receptacle (80) when the receptacle (80) is held by the receiving component.

3. The device (200) according to claim 1, wherein the nozzle (80) is capable of delivering a cleaning medium to an interior wall of the receptacle (80) to clean at least a part of the interior wall of the receptacle (80).

4. The device according to claim 1, wherein the first rotating element (90) comprises one or more magnets (315) and/or the second rotating element (130) comprises one or more magnets (460); wherein the one or more magnets (315), (460) is configured to cause rotation of the first rotating element (90) or rotation of the second rotating element (130).

5. The device according to claim 4, wherein the one or more magnets (315) of the first rotating element (90) and the one or more magnets (460) of the second rotating element (130) are disposed apart from each other in a direction substantially perpendicular to an axis of rotation of the first rotating component (90).

6. The device according to claim 4, wherein the receiving component comprises a support element to support the first rotating element; wherein the support element extends into the receiving component by a distance smaller than a width of the one or more magnets of first rotating component (90) and/or the second rotating component (130).

7. The device according to claim 4, wherein the height of a coupling region containing the one or more magnets (315) of the first rotating component (90) and the one or more magnets (460) of the second rotating component (130) in a direction parallel to the axis of rotation of the first rotating component (90) is less than the combined height of a magnet of the one or more magnets (315) of the first rotating component (90) and a magnet of the one or more magnets (460) of the second rotating component (130).

8. The device according to claim 1, wherein the first rotating element (90) comprises one or more magnets (315) and the second rotating element (130) comprises one or more corresponding, reversed polarity magnets (460); wherein the one or more corresponding, reversed polarity magnets (315), (460) are configured to cause rotation of the first rotating element (90) on rotation of the second rotating element (130), wherein the one or more magnets (315) of the first rotating element (90) and the one or more magnets (460) of the second rotating element (130) are arranged coaxially with respect to an axis of rotation of the first rotating component (90).

9. The device according to claim 1, wherein the first rotating element (90) is capable of disengaging and/or slipping from the second rotating element (130);

wherein the first rotating element (90) disengages and/or slips from the second rotating element (130) when there is a force opposing the rotation of the first rotating element (90) that exceeds the force of the magnetic coupling between the first rotating element (90) and the second rotating element (130), and/or when a force of less than about 300 Newton-centimetres or more is applied at the pivot point of the first rotating element (90).

10. The device according to claim 1, wherein the device does not comprise a mechanical connection between the first rotating element (90) and the second rotating element (130) and/or any other part of the device (200).

11. The device according to claim 1, wherein the device comprises a watertight barrier between the first rotating element (90) and the second rotating element (130).

12. The device according to claim 1, wherein the receiving component of the device comprises a basin element (320) that is capable of capturing spent cleaning medium, wherein the second rotating element (130) is located outside of the basin element (320).

13. The device according to claim 1, wherein the first rotating element (90) comprises a turntable element that is capable of rotating the receptacle (80) and wherein the cleaning element (110) extends beyond the turntable element.

14. The device according to claim 1, wherein the rotation driving component (400) further comprises a means for driving the rotation of the second rotation element (130), wherein the means for driving the rotation of the second rotating element (130) comprises a motor (150).

15. The device according to claim 1, wherein the basin element (320) comprises a drain outlet for removal of spent cleaning medium (95).

16. The device according to claim 1, wherein the cleaning component comprises a cleaning medium preparation element (1) that is operably connected to the cleaning element (110).

17. The device according to claim 1, wherein the cleaning medium comprises steam.

18. The device according to claim 1, wherein the device further comprises a user interface module (200) to allow a user to use the device, wherein the user interface module (200) allows for the rotational speed of the first rotating device (90) to be altered.

19. A device (200) for cleaning a receptacle (80) that is at least partly open-ended at one end (81) and having an interior space (82) defined by an interior wall (83);

wherein the device is capable of cleaning at least a part of the interior wall of the receptacle (80);

wherein the device comprises (a) a receiving component for receiving and holding the receptacle (80) to allow for the cleaning of at least the part of the interior wall of the receptacle (80), wherein the receiving component comprises a first rotating element (90) that is capable of rotating the receptacle (80);

(b) a cleaning component that is capable of cleaning at least part of the interior wall of the receptacle interior wherein the cleaning component comprises a cleaning element (110) that is locatable within the interior space of the receptacle (80) when the receptacle (80) is held by the receiving component; and (c) a rotation driving component (400) that is capable of driving rotation of the first rotating element (90), wherein the rotation driving component comprises a second rotating element (130);

wherein the cleaning element is capable of delivering a cleaning medium to the interior wall of the receptacle (80) to clean at least a part of the interior wall of the receptacle (80);

further wherein the first rotating element (90) is magnetically coupled to the second rotating element (130), wherein the second rotating element (130) is configured to cause rotation of the first rotating element (90) on rotation of the second rotating element (130).

20. A method of cleaning a receptacle comprising use of a device (200) for cleaning a receptacle (80), wherein the device (200) comprises:

a receiving component for receiving and holding the receptacle (80), wherein the receiving component comprises a first rotating element (90) that is capable of rotating the receptacle (80);

a nozzle (110) arranged to be directed at an interior of the receptacle (80) when the receptacle (80) is held by the receiving component; and a rotation driving component (400) comprising a second rotating element (130), wherein the rotation driving component (400) is arranged to drive rotation of the second rotating element (130);

wherein the second rotating element (130) is magnetically coupled to the first rotating element (90) such that rotation of the second rotating element (130) by the rotation driving component (400) drives rotation of the first rotating element (90), the method comprising:

receiving the receptacle (80) at the receiving component of the device (200);

rotating, by the rotation driving element (400), the second rotating element (130) to drive rotation of the first rotating element (90); and delivering, via the nozzle (110) a cleaning medium to an interior wall of the receptacle (80) to clean at least a part of the interior wall of the receptacle (80).

* * * * *